US007553807B2

(12) United States Patent
Arai et al.

(10) Patent No.: US 7,553,807 B2
(45) Date of Patent: Jun. 30, 2009

(54) SURFACTANT-FREE DETERGENT COMPOSITION COMPRISING AN ANTI-SOIL REDEPOSITION AGENT

(75) Inventors: Kazuyoshi Arai, Kanagawa (JP); Tomoki Seo, Kanagawa (JP)

(73) Assignee: Miz Co., Ltd., Kanagawa (JP)

( * ) Notice: Subject to any disclaimer, the term of this patent is extended or adjusted under 35 U.S.C. 154(b) by 0 days.

(21) Appl. No.: 12/167,432

(22) Filed: Jul. 3, 2008

(65) Prior Publication Data

US 2008/0280804 A1 Nov. 13, 2008

Related U.S. Application Data

(63) Continuation of application No. 10/433,667, filed as application No. PCT/JP01/10642 on Dec. 5, 2001, now Pat. No. 7,407,924.

(30) Foreign Application Priority Data

Dec. 5, 2000 (JP) ..... 2000-370238
Apr. 4, 2001 (JP) ..... 2001-106419

(51) Int. Cl.
*C11D 7/00* (2006.01)
*C11D 7/12* (2006.01)
*C11D 7/14* (2006.01)

(52) U.S. Cl. ..... 510/400; 510/276; 510/299; 510/300; 510/309; 510/367; 510/374; 510/470; 510/471; 510/478; 510/509; 510/511

(58) Field of Classification Search ..... 510/276, 510/299, 300, 309, 367, 374, 400, 470, 471, 510/478, 509, 511
See application file for complete search history.

(56) References Cited

U.S. PATENT DOCUMENTS

| | | | | |
|---|---|---|---|---|
| 3,655,568 | A * | 4/1972 | Zaki et al. | 510/374 |
| 3,962,106 | A * | 6/1976 | Rubin et al. | 510/368 |
| 4,025,450 | A * | 5/1977 | Lamberti et al. | 510/479 |
| 4,219,436 | A * | 8/1980 | Gromer et al. | 510/224 |
| 4,279,766 | A * | 7/1981 | Joubert et al. | 510/236 |
| 4,309,299 | A * | 1/1982 | Rapisarda et al. | 510/381 |
| 4,379,069 | A * | 4/1983 | Rapisarda et al. | 510/230 |
| 4,464,281 | A * | 8/1984 | Rapisarda et al. | 510/220 |
| 5,002,682 | A * | 3/1991 | Bragg et al. | 510/311 |
| 5,208,369 | A * | 5/1993 | Crump et al. | 562/106 |
| 5,316,691 | A * | 5/1994 | Sone et al. | 510/392 |
| 5,595,968 | A * | 1/1997 | Gopalkrishnan et al. | 510/418 |
| 5,616,547 | A * | 4/1997 | Ponce et al. | 510/230 |
| 6,200,351 | B1 * | 3/2001 | Schleinig et al. | 8/115.6 |
| 6,376,227 | B1 * | 4/2002 | Takaiwa et al. | 435/219 |
| 6,743,616 | B2 * | 6/2004 | Araki et al. | 435/202 |
| 7,091,171 | B2 * | 8/2006 | Caswell et al. | 510/439 |
| 2005/0202990 | A1 * | 9/2005 | Caswell et al. | 510/295 |

FOREIGN PATENT DOCUMENTS

| | | | |
|---|---|---|---|
| EP | 1 022 334 | B1 | 8/2007 |
| GB | 1 368 400 | | 9/1974 |
| JP | 48-25693 | | 4/1973 |
| JP | 8-283783 | A | 10/1996 |
| JP | 11-256192 | A | 9/1999 |
| JP | 2000-184883 | A | 7/2000 |
| WO | WO 99/37414 | A1 | 7/1999 |
| WO | WO 00/20549 | A1 | 4/2000 |

* cited by examiner

*Primary Examiner*—Charles I Boyer
(74) *Attorney, Agent, or Firm*—Arent Fox LLP

(57) ABSTRACT

Washing is carried out using a detergent composition having main detergency obtained through an alkaline inorganic salt and further including at least an anti-soil redeposition agent. There is provided a clothes washing method, and a detergent composition for the same, that uses a detergent having detergency equivalent to or greater than that of synthetic detergents containing a surface active agent as the main detergency ingredient and also has excellent anti-soil redeposition efficiency wherein main detergency is obtained by an alkaline inorganic salt.

2 Claims, 2 Drawing Sheets

SURFACTANT-FREE DETERGENT COMPOSITION COMPRISING AN ANTI-SOIL REDEPOSITION AGENT

This application is a continuation application of U.S. application Ser. No. 10/433,667, filed Nov. 17, 2003, which is a 371 National Stage Entry of International Appl. No. PCT/JP2001/10642, filed Dec. 5, 2001. The disclosures of the prior applications are hereby incorporated herein in their entirety by reference.

TECHNICAL FIELD

The present invention relates to a method of laundering clothing using detergency having alkaline inorganic salt as a main ingredient and a detergent composition for the same.

BACKGROUND ART

Due to superior cleaning power and good handlability, synthetic detergents in the laundering of clothing have gained overwhelming support. However, not all of the gains to consumers from synthetic detergents are positive. For example, while synthetic detergents have gone through many improvement processes in response to the issue of environmental burden caused by alkylbenzene sulfonic acid soda and phosphate builders blended therein, issues have recently begun to be raised regarding adverse affects on organisms from synthetic detergents including the possibility of being an endocrine disrupting chemical. Also, the fact cannot be escaped that a substantial amount of surface-active agents included in synthetic detergents remains on clothing despite careful rinsing, nor may the probability be denied that such a surface-active agent passes through the skin to bring about any number of affects on the human body. Furthermore, the large quantity of water that is drained away over the course of the plurality of rinses in order to remove the surface-active agent is a precious resource that should not be wasted.

Soaps that have been in use for a long time and considered safe cannot be a substitution even for those who question safeness of synthetic detergents due to the inferior handlability thereof. In addition, if a large amount must be used, even soaps having better biodegradability compared to synthetic detergents do not seem to necessarily lead to a reduction in impact on the environment.

Although excellent detergency through surface-active agents is widely known, when considering the effects on living beings and the environment, appearance of a new detergent having no added surface-active agent or including a drastically reduced amount of surface-active agent, yet having the same cleaning power and handlability as synthetic detergents has been awaited.

Laundry detergent having substantially no added surface-active agent and having alkaline inorganic salt is a main ingredient is in use, as well as the washing soda (sodium carbonate hydrate) of old. More recently, as disclosed in Japanese Patent Application Laid-open No. Hei 9-87678, a detergent is proposed having added sodium bicarbonate (baking soda) and further including an enzyme with the aim of strengthening cleaning power.

Nevertheless, these conventionally used laundry detergents having no alkaline inorganic salt added as a main ingredient are inferior in detergency and handlability compared with laundry soaps and synthetic detergents, and in particular lag behind synthetic detergents.

An object of the present invention is to provide a detergent composition and washing method using the same, wherein the detergent composition includes substantially no surface-active agents, which have been questioned in terms of safeness on the human body and reduction in environmental impact, or having an amount of surface-active agent that is drastically reduced while having detergency and handlability that is equivalent or superior to that of conventional laundry soaps and synthetic detergents having a surface-active agent as a main ingredient.

DISCLOSURE OF INVENTION

In consideration of the above objects, the inventors of the present invention turned their attention to a detergent wherein main detergency is obtained through an alkaline inorganic salt, that is, using an alkaline inorganic salt as a main ingredient of detergency, and as a result of intensive studies, they reached the idea that a composition of the alkaline inorganic salt was not suitable in detergents of the related art containing alkaline inorganic salt as a main ingredient, and furthermore, as a larger factor, due to the fact that the detergents of the related art have almost no anti-soil redeposition efficiency, implementation of practical detergency has been prevented.

Namely, detergency in clothes washing is obtained by having both detergency, which detaches soil from clothing, and anti-soil redeposition efficiency so as to not soil clothing again with soil dispersed in the washing liquid through redeposition. When anti-soil redeposition efficiency is insufficient, the goal of washing cannot be sufficiently attained due to redeposition when washing badly soiled clothing, whereas when washing lightly soiled washing, soil is accumulated through repeated washing that results in grayish clothing. Just the same, it must be said that the detergency is not sufficient.

The inventors of the present invention turned their attention to the above disadvantages of alkaline inorganic salt detergents, studied mainly the composition of alkaline inorganic salt detergents and an anti-soil redeposition agents, and further considered small amounts of additives in order to find and provide a detergent composition that uses substantially no surface-active agent, contains an alkaline inorganic salt as the main ingredient, and has detergency and handlability equivalent to or greater than those of washing soaps or synthetic detergents as well as a washing method using the same. Thus the present invention was completed.

(1) Alkaline Inorganic Salt Detergent

According to the present invention, there is provided a detergent composition for clothing that has an inorganic salt forming an alkaline buffer system as a main component for detergency and further includes at least an anti-soil redeposition component.

1-1) Composition of Alkaline Inorganic Salt:

Alkaline inorganic salt in the present invention contains as main components a pH buffer action salt for main pH buffer action and an alkaline inorganic salt for main alkali action. The pH provided by a standard concentration of a washing liquid when dissolving a detergent composition of the present invention into washing water has a pH of 9 to 11, which is in the alkalescent range, and washing capable of securing sufficient safeness to users can be attained without damaging fibers.

Generally, high detergency in the alkalescent range of pH 9 to 11 is demanded in clothes washing. However, since the pH of an alkali agent depends on concentration, the usage concentration has to be low level so as to converge the pH into such an alkalescent range, sufficient detergency could consequently not be obtained. As to the pH, concentration and detergency, data was obtained as shown in Table 1.

TABLE 1

| KINDS OF WASHING LIQUID | | RATIO OF MIXTURES g | DETERGENCY RATIO % | pH | g/L |
|---|---|---|---|---|---|
| SODIUM HYDROXIDE SOLUTION | | | | | |
| pH 9 | | ALONE | 13.8 | 9.0 | 0.006 |
| pH 10 | | ALONE | 15.7 | 9.8 | 0.026 |
| pH 11 | | ALONE | 19.5 | 10.7 | 2.250 |
| SODIUM CARBONATE SOLUTION | | | | | |
| pH 9 | | ALONE | 13.8 | 8.8 | 0.015 |
| pH 10 | | ALONE | 15.8 | 9.9 | 0.100 |
| pH 11 | | ALONE | 22.0 | 11.0 | 1.100 |
| BICARBONATE SOLUTION | | | | | |
| 30 g | | ALONE | 15.9 | 8.3 | 1.0 |
| 60 g | | ALONE | 14.6 | 8.4 | 2.0 |
| 90 g | | ALONE | 15.9 | 8.3 | 3.0 |
| SODIUM CARBONATE + BICARBONATE | | | | | |
| pH 9 | 30 g | T3 + J27 | 13.8 | 9.0 | 1.0 |
| | 60 g | T6 + J54 | 17.1 | 9.1 | 2.0 |
| | 90 g | T9 + J81 | 19.2 | 9.1 | 3.0 |
| pH 10 | 30 g | T15 + J15 | 17.5 | 10.0 | 1.0 |
| | 60 g | T30 + J30 | 19.2 | 10.1 | 2.0 |
| | 90 g | T45 + J45 | 22.0 | 10.1 | 3.0 |
| pH 11 | 30 g | — | — | — | — |
| | 60 g | T58 + J2 | 22.5 | 11.0 | 2.0 |
| | 90 g | T87 + J3 | 26.1 | 11.1 | 3.0 |
| METASILICATE + BICARBONATE | | MF19 + J11 | 18.8 | 10.5 | 1.0 |
| SODIUM CARBONATE + BICARBONATE | | T25 + J5 | 19.8 | 10.5 | 1.0 |
| DETERGENT OF PRESENT INVENTION | | 30 | 25.7 | 10.5 | 1.0 |

COMPOSITION OF MIXTURES: T—SODIUM CARBONATE J—SODIUM HYDROGEN CARBONATE MF—SODIUM METASILICATE 5-HYDRATE
RATIO OF MIXTURES: FOR EXAMPLE, T3 + J27 EXPRESSES SODIUM CARBONATE 3 g + SODIUM HYDROGEN CARBONATE 27 g

According to Table 1, since sufficient concentration cannot be obtained in the range at or below pH 10 in the case of alkali salt alone, so the detergency became substantially the same as that of a sodium hydrogen carbonate solution having a pH approximately 8.3. Meanwhile, in the case of a system of blended bicarbonate instead of a system of alkali salt alone, it was learned that detergency substantially the same as that in the case of a high pH can be obtained by making the concentration high even when pH is relatively low, but in the range of not less than a pH 9.

Accordingly, when pH buffer action salt, such as bicarbonate, coexists, a buffer system is formed, promotion of alkalization along with an increase of a concentration of the alkali action salt can be suppressed, and the concentration of an alkali agent can be made sufficiently high.

In a solution of carbonate and bicarbonate, the ratio with which a carbonate ion having an ionic charging number of −2 and a bicarbonate ion having an ionic charging number of −1 exist depends on the pH of the solution, and it becomes approximately 1:1 in the case of pH 10.3. The carbonate ion increases in the high pH range, while the bicarbonate ion changes further into a carbon dioxide gas in the low pH range. Also, the higher the existence ratio of the bicarbonate ion, the stronger is the buffer action, and the pH changes little when the concentration changes. Accordingly, by mixing carbonate (carbonate ion) and bicarbonate (bicarbonate ion), a pH in the alkalescent range may be obtained, the alkali agent concentration may be made high, and a washing liquid having a little pH change due to alkali agent concentration may be made (see Table 2).

TABLE 2

| | WASHING LIQUID CONCENTRATION (g/L) | | | |
|---|---|---|---|---|
| | 100 | 10 | 1 | 0.1 |
| TEST LIQUID A—pH | 12.0 | 11.6 | 11.2 | 10.6 |
| TEST LIQUID B—pH | 10.4 | 10.5 | 10.6 | 10.4 |

*TEST LIQUID A = SODIUM CARBONATE SOLUTION
*TEST LIQUID B = DETERGENT SOLUTION OF PRESENT INVENTION (COMPONENT RATIO WEIGHT % = CARBONATE 75%/BICARBONATE 25%)
*ANHYDROUS POWDER IS USED FOR RESPECTIVE CHEMICAL AGENTS

Furthermore, even when acid soiling is mixed in with the washing liquid, since a pH buffer action salt works to suppress acidification promotion in the washing liquid, the effect of converging and maintaining the washing liquid in an alkalescent range suitable for washing may be expected.

As pH buffer action salt in the present invention, for example, bicarbonate alkali metal salt, boric acid alkali metal salt, phosphate alkali metal salt, etc. may be given, and accessory use of an organic salt, such as oxalate alkali metal salt, phthalic acid alkali metal salt may be possible. Also, as an alkali action salt according to the present invention, for example, carbonate alkali metal salt, silicic acid alkali salt, or the like may be given.

In the present invention, the above inorganic salt preferably contains as a main component bicarbonate alkali metal salt, carbonate alkali metal salt, and/or silicic acid alkali metal salt. As described above, pH buffer action is the main role of the bicarbonate alkali metal salt, and promotion of alkalization in the fluidity of the washing liquid is the main role of the carbonate alkali metal salt and silicic acid alkali metal salt.

Note that a composition of alkaline inorganic salt of the present invention basically contains a bicarbonate alkali metal salt to utilize the pH buffer action thereof, but when a pH 11 or so is attained using only a carbonate alkali metal salt, the detergency required by the present invention is attained and it becomes a system having some buffer action, causing it to be included in the range of an alkaline inorganic salt of the present invention.

Also, carbonate alkali metal salt has a preferable softening promotion action as will be explained later on, while, silicic acid alkali metal salt improves anti-soil redeposition efficiency, has a rust prevention action of a metal surface of a washing machine, and also has an action of preventing hardness components from adhering to the draining system.

Silicic acid alkali metal salt, in particular sodium metasilicate, generates colloids in washing liquid and has the actions of absorbing inorganic soil particles and disperse into the washing liquid, so that absorption of soil particles to fabrics, that is redeposition, can be prevented. Also, silicic acid alkali metal salt, in particular sodium metasilicate (5-hydrate), can be replaced by sodium carbonate at any ratio without reducing detergency.

Note that it is preferable to set the concentration of silicic acid alkali metal salt to be 0.001 mol/liter or more in the washing liquid to give sufficient anti-soil redeposition efficiency.

In the present invention, the blending ratio of a total amount of the above inorganic salt to a total amount of a detergent composition is preferably no less than 90 wt %. Under a condition of containing a later-explained anti-soil redeposition agent so that anti-soil redeposition efficiency reaches to a level equivalent to that of existing washing soaps and synthetic detergents, the inorganic salt blending ratio is more preferably no less than 91 wt %. The larger the blending ratio of inorganic salt in the detergent composition, the more preferable is, in order, no less than 92 wt %, no less than 93 wt %, no less than 94 wt %, no less than 95 wt %, no less than 96 wt %, no less than 97 wt %, no less than 98 wt %, and no less than 99 wt % as with the above. This is because the effect on improved detergency by the main ingredient may be obtained.

In the present invention, the component ratio of the content mol number of the above bicarbonate alkali metal salt and the content mol number of the above carbonate alkali metal salt is more preferably between 1:7 to 1:0.2. In the present invention, to prevent beforehand disadvantages of damage to fabrics, skin damage, required waste water treatment, etc. due to the fluidity of the washing liquid getting close to strong alkali, pH of the washing liquid (for example, a concentration of 1 g/liter (0.1 wt %)) at the time of washing is converged to an alkalescent range of pH 9 to 11 by containing as an essential component the bicarbonate alkali metal salt as a pH buffer action salt. The component ratio of the content mol number of the bicarbonate alkali metal salt and content mol number of the carbonate alkali metal salt, which can form the above pH buffer system, corresponds to 1:7 to 1:0.2.

Similarly, in the case of a combining bicarbonate alkali metal salt and silicic acid alkali metal salt, the component ratio of content mol numbers is preferably 1:1.2 to 1:0.1.

Furthermore, when three species: bicarbonate alkali metal salt, carbonate alkali metal salt and silicic acid alkali metal salt are mixed to be used as inorganic salt forming the alkaline buffer system as the above main component for detergency. Preferably, the blend amount of the silicic acid alkali metal salt is set so that the component ratio becomes 20 to 90 wt %, preferably 30 to 70 wt % of the total weight of the detergent, considering the anti-soil redeposition efficiency brought by the silicic acid alkali metal salt, for example, sodium metasilicate.

The above total amount of inorganic salt, the blending ratio of bicarbonate alkali metal salt and carbonate alkali metal salt and/or silicic acid alkali metal salt can be suitably selected in accordance with washing conditions, such as kind of clothing as an object in the detergent composition, hardness of water in a target sales area, washing temperature, and type of washing machine. For example, when washing easily damaged clothing, blending of a low alkali degree, that is a high ratio of bicarbonate alkali metal salt, should be adopted, and in a detergent composition targeting an area of hard water, it is preferable that carbonate alkali metal salt be blended in large amounts at a high ratio by attaching much importance to the softening action.

When using sodium chloride as bicarbonate alkali metal salt and carbonate alkali metal salt in the above inorganic salt combination, sesqui carbonate having an equivalent mol mixture as these substances may be exchanged in the range of the above component ratio.

1-2) pH of Washing Liquid and Inorganic Salt Concentration

The pH of washing liquid can be adjusted through the blending ratio of bicarbonate alkali metal salt, for example, sodium bicarbonate in the main ingredient mixture. The relationship of the pH and detergency was examined through a washing liquid wherein a mixture of sodium carbonate having the simplest composition and sodium bicarbonate are dissolved in tap water. The results are shown in Table 3.

TABLE 3

| DETERGENT COMPOSITION (g) | BLENDING RATIO | pH | DETERGENCY RATIO % | NOTE |
|---|---|---|---|---|
| SODIUM CARBONIC ACID 0 + BICARBONATE 0 | 0:0 | 7.4 | 16.6 | pH IS VALUE OF TAP WATER |
| SODIUM CARBONIC ACID 1 + BICARBONATE 24 | 1:24 | 8.5 | 17.5 | |
| SODIUM CARBONIC ACID 5 + BICARBONATE 20 | 1:4 | 9.3 | 18.1 | |
| SODIUM CARBONIC ACID 10 + BICARBONATE 15 | 2:3 | 9.8 | 21.7 | |
| SODIUM CARBONIC ACID 20 + BICARBONATE 5 | 4:1 | 10.5 | 24.7 | |

*pH OF WASHING LIQUID WAS ADJUSTED BY CHANGING BLENDING RATIO OF SODIUM BICARBONATE AND SODIUM CARBONATE

From Table 3, a significant difference is not observed up to pH 9.3 or so compared with the case of tap water only, but detergency significantly rises after exceeding a pH 9.5 or so. The detergency tends to still rise on the higher pH side in the alkalescent range, however, the upper limit of the preferable pH is determined by observing compatibility with, for example, an enzyme to be added.

Accordingly, in terms of detergency, the pH of the washing liquid when dissolving a detergent composition of the present invention with a standard usage concentration in water, for example, 1 g/liter (concentration of 0.1 wt %) is preferably no less than 9.5.

Next, the relationship of the inorganic salt concentration and detergency in the washing liquid of the present invention is shown in Table 4 and FIG. 1.

TABLE 4

| WASHING LIQUID CONCENTRATION (g/L) | pH | DETERGENCY RATIO % |
|---|---|---|
| 0.5 | 10.3 | 21.6 |
| 1 | 10.4 | 31.5 |
| 1.2 | 10.5 | 35.8 |
| 1.5 | 10.4 | 36.5 |
| 1.8 | 10.6 | 36.6 |
| 2.5 | 10.6 | 43.4 |
| 2.7 | 10.6 | 45.3 |
| 3.6 | 10.7 | 43.7 |
| 6 | 10.8 | 44.9 |

*BLENDING RATIO OF MAIN INGREDIENT IS CARBONATE:BICARBONATE = 2:1

A higher concentration of inorganic salt tends to give better detergency, however, improvement in detergency is hardly observed following a certain point. Also, as a characteristic of this detergent, there are two "stacks" where change in improvement of detergency becomes almost flat. There is a relatively large difference in detergency between the first stack and the second stack, with the detergency better in one with the higher concentration. However, the concentration is more than double and the increase in the usage amount per one time is large.

There are many viewpoints regarding setting the standard concentration of inorganic salt in the washing liquid, such as the performance aspect, environmental compatibility aspect, and cost aspect, however, it is thought that the minimum concentration should be set to where there is substantially no problem with detergency. Namely, in the case of a powder detergent of the present invention under washing conditions with water of low hardness and low temperature as in Japan, a usage concentration of 30 to 60 g per 30 liters of washing water, in other words, 1 to 2 g per liter (hereinafter, also abbreviated as L) is suitable.

Note that the alkaline inorganic salt washing liquid of the present invention includes an alkaline inorganic salt solution having a pH of 9 to 11 including a carbonate ion and bicarbonate ion generated by performing electrolysis on sodium bicarbonate (also referred to as sodium carbonate) solution which is already filed by the inventors of the present invention, published and disclosed in Japanese Patent Application Relaid-Open No. Hei 11-837414 and No. 2000-8205949, incorporated herein by reference.

1-3) Softening of Washing Water

Polyvalence cation (hardness component) represented by calcium ion and magnesium ion contained in tap water and well water draws soil having a negatively charged surface and fabrics in a form that bridges both in the washing water, which becomes one cause of redeposition of soil on a fabric surface. In the inorganic salt detergent of the present invention, the polyvalence cation bonds with the carbonate ion contained in the washing water and generates carbonate salt that is insoluble in the washing water so that factors caused by the polyvalence cation to hinder detergency are reduced. Carbonate ion is consumed through a process of generating insoluble carbonate, but since concentration of the carbonate alkali metal salt is far higher than that of polyvalence cation, when comparing a synthetic detergent based on the idea of handling a hardness component with the smallest possible amount of builder necessary for a surface-active agent to work with the detergent of the present invention, the detergent of the present invention is affected less by hardness of the washing water. Note that in areas where an amount of hardness component in the washing water is extremely small, it is necessary to secure detergency by sufficiently heightening the carbonate ion amount in the detergent of the present invention, that is, increasing detergent concentration.

Nullification of the hardness components, in other words, the progression of softening changes as below in accordance with a state and condition of the washing liquid in which the detergent of the present invention is dissolved. This is shown in Table 5.

TABLE 5

| | | pH | Ca HARDNESS | OVERALL HARDNESS |
|---|---|---|---|---|
| | DILUTION WATER (MUNICIPAL TAP WATER) | 7.4 | 40 | 60 |
| LEFT AFTER DILUTION | IMMEDIATELY AFTER | 10.5 | 40 | 60 |
| | AFTER 30 MINUTES | 10.5 | 20 | 40 |
| | AFTER 1 HOUR | 10.5 | 15 | 35 |
| | AFTER 2 HOURS | 10.4 | 6 | 25 |
| | AFTER 3 HOURS | 10.5 | 6 | 25 |
| NO-LOAD MIXTURE | IMMEDIATELY AFTER | 10.4 | 35 | 55 |
| | AFTER 5 MINUTES | 10.5 | 35 | 55 |

TABLE 5-continued

| | | pH | Ca HARDNESS | OVERALL HARDNESS |
|---|---|---|---|---|
| | AFTER 10 MINUTES | 10.4 | 25 | 50 |
| | AFTER 15 MINUTES | 10.4 | 15 | 45 |
| | AFTER 20 MINUTES | 10.4 | 10 | 35 |
| | AFTER 25 MINUTES | 10.4 | 10 | 35 |
| LOAD MIXTURE | IMMEDIATELY AFTER | 10.5 | 40 | 60 |
| | AFTER 5 MINUTES | 10.4 | 15 | 35 |
| | AFTER 10 MINUTES | 10.4 | 10 | 30 |
| | AFTER 15 MINUTES | 10.4 | 10 | 25 |
| | AFTER 20 MINUTES | 10.4 | 6 | 25 |

*DETERGENT COMPOSITION (WEIGHT RATIO) IS SODIUM CARBONATE:SODIUM BICARBONATE = 2:1

According to Table 5, the reaction slowly proceeds when being left standing as is and it takes almost 3 hours to descend to low hardness, which is effective in improving detergency. However, when the physical force of mixing is added after dissolving and diluting, the reaction is accelerated and it takes about 30 minutes to lower the hardness to the same degree. Furthermore, when a cloth is added and it is mixed, this time is reduces to 5 to 10 minutes. Such a characteristic is convenient in washing. These reaction accelerating elements are the same as physical action provided by normal washing with a washing machine, so acceleration of softening may be performed without adding any special operation.

Here, the mechanical force of mixing is effective in increasing contact opportunities between the polyvalence cation and carbonate ion in the washing water, and an increase of molecular motion by ultrasonic wave vibration and heating have the same efficiency. Also, it is considered that the reaction acceleration when loading cloth, such as clothing is affected by fine calcium carbonate adhered on the cloth surface that serves as a catalyst.

When hardness of the washing water is even higher, it would seem as if the softening time would become longer in proportion with the hardness, but actually, a higher initial hardness gives a steeper hardness lowering rate, thus the hardness lowers to an equivalent hardness after approximately 15 minute length of time has passed regardless of the initial hardness when adding the cloths.

Note that the hardness component in the washing liquid is not only those included in the washing water but a total amount of those adhered on clothing to be washed during rinsing, but also that included, for example, in sweat from the human body, and that included in the adhered soil. Since they gradually dissolve into the water, the hardness of the washing liquid does not be below a certain value, rather there are cases where hardness increases when a washing time lengthened.

Here, the relationship of the pH and the softening effect at the time a concentration of the washing liquid is made constant (0.8 g/L) is examined.

First, pH was changed by changing the mixing ratio of sodium carbonate and sodium bicarbonate as main ingredients, and changes in the length of hardness declining time were examined. The results are shown in Table 6.

TABLE 6

RELATIONSHIP BETWEEN pH AND SOFTENING TIME. NOTE THAT HARDNESS IS OVERALL HARDNESS (ppm)

| MAIN INGREDIENT | | TIME PASSED (MINUTE) | | | | | | |
|---|---|---|---|---|---|---|---|---|
| BLENDING RATIO | pH | 0 | 5 | 10 | 15 | 20 | 25 | 30 |
| TAP WATER | 7.3 | 50 | 60 | 60 | 60 | 60 | 65 | 65 |
| T1 + J24 | 8.5 | 65 | 70 | 65 | 60 | 60 | 60 | 60 |
| T5 + J20 | 9.3 | 55 | 50 | 40 | 40 | 35 | 35 | 30 |
| T10 + J15 | 9.8 | 55 | 35 | 25 | 25 | 25 | 25 | 25 |
| T20 + J5 | 10.4 | 70 | 35 | 30 | 25 | 25 | 25 | 25 |

*MAIN INGREDIENT BLENDING RATIO IN EACH pH
pH 7.5 . . . TAP WATER ONLY
pH 8.5 . . . SODIUM CARBONATE 1 g + BICARBONATE 24 g (T1 + J24)
pH 9.3 . . . SODIUM CARBONATE 5 g + BICARBONATE 20 g (T5 + J20)
pH 9.8 . . . SODIUM CARBONATE 10 g + BICARBONATE 15 g (T10 + J15)
pH 10.4 . . . SODIUM CARBONATE 20 g + BICARBONATE 5 g (T20 + J5)

According to Table 6, it may be understood that there is a large change between a pH of 9.3 and pH 9.8, with a higher pH giving a shorter hardness decline time, but reaches an upper limit once exceeding a pH of 9.8. From the results, it may be understood that the pH is preferably set to be no less than 9.5 in order to effectively lower hardness.

Accordingly, in terms of a softening rate in addition to detergency, a pH of the washing liquid is preferably no less than 9.5.

As explained above, since the main component has the effect of reacting with hardness components, which becomes a detergency hindering factor that leads to their nullification in this washing liquid, a softening effect in practical use may be obtained without particularly adding an organic chelate agent normally used as a synthetic detergent component nor a water insoluble zeolite as a softening agent. However, when attempting further performance improvement by adding a softening agent, such as chelate agent, to this washing detergent, a more effective softening promotion may be attained with a small amount of softening agent by performing softening promotion in the above explained method and adding a softening agent part-way through, such as a chelate agent, after a certain length of time has passed. Note that in the case of zeolite having a relatively long reaction time, it is difficult to obtain the same effect within a predetermined washing time of 8 to 12 minutes with the premise of adding part-way through. As another softening agent, a fatty acid soap may be preferably used in terms of resolvability and safeness. In this case, since the objective is to soften, the addition of an amount to make the best use of detergency is not necessary. Also, since alkali components are contained in the washing liquid, a method of adding a fatty acid, such as olein acid instead of fatty acid salt to generate a metal soap in the washing liquid may be used as well.

(2) Anti-Soil Redeposition Component

In synthetic detergents, a surface-active agent has not only detergency but also sufficient dispensability (anti-soil redeposition efficiency) by itself, but a small amount of anti-soil redeposition agent is often added to further improve anti-soil redeposition efficiency. In particular, dispensability of solid particle soil relates to redeposition (resoiling) of removed soil, and many surface-active agents have the ability to absorb and disperse solid particle soil.

In the inorganic salt of the present invention, however, such an ability of dispersing solid particles cannot be expected. Thus, in the washing liquid of the inorganic salt alone, in an actual washing system wherein oil-based soil and hydrophobic soil exist besides the solid particle soil being conjugated, adhesion of soil to the washing tank cannot be prevented not to mention adhesion and redeposition to clothing.

Generally, various anti-soil redeposition mechanisms, such as dissolving soil, dispersion, and electrically repulsive force between fabrics and soil may be considered. The inventors of the present invention set as their objective giving anti-soil redeposition efficiency to an inorganic detergent of the present invention. After intensive study, they found that soil redeposition arose when surface tension of washing liquid was high and that soil redeposition could be substantially prevented by an extremely slight decline in surface tension (about 58 dyn/cm or less). However, they learnt that it is applicable for anti-soil redeposition mainly in fabrics having hydrophilic properties and that absorption efficiency for hydrophobic fabrics and nonpolar soil, that is efficiency in dispersing the same, is further required to more sufficiently obtain anti-soil redeposition efficiency in the present invention. Also, they learnt that, in a washing liquid system of the present invention wherein inorganic salt is a main component for detergency, since the ion content was originally large, adding an anti-soil redeposition component and expecting an electrostatic repulsive force was not effective. What mattered was the nonpolar solid soil particles not affected by electrostatic absorption, the mixture of solid soil particles and hydrophobic soil, and furthermore, anti-soil redeposition on hydrophobic fabrics.

Accordingly, to obtain the anti-soil redeposition efficiency required in the present invention, it is preferable that both (1) efficiency in causing surface tension of a washing liquid to decline to the above predetermined surface tension or lower (referred to as a surface tension declining ability) and (2) efficiency of dispersing soil by absorbing with hydrophobic fabrics and nonpolar soil (referred to as a hydrophobic anti-soil redeposition ability) be provided.

Here, a "predetermined" surface tension declining ability means the ability to cause surface tension to decline to 58 dyn/cm or less in a washing liquid obtained by dissolving in water an inorganic salt detergent of the present invention with an actually used concentration of 1 g/L (0.1 wt %) as the standard detergent concentration. As for the surface tension declining ability acting on the present washing liquid, "a china ink test" was conducted with the objective of confirming the limit necessary to expecting an anti-soil redeposition ability that is practical in usage. With this china ink test, behavior of the china ink was observed when dripping a small amount of china ink into respective washing liquids of the present invention at respective concentrations and judging whether a surface tension decline action exists or not in the washing liquid of the present invention at the respective concentrations based on whether the ink spreads on the surface to soil the inner wall of the washing tank (no surface tension decline action), the ink drops vertically with respect to the washing liquid surface, or disperses in the washing liquid (surface tension decline action exists). The results are shown in Table 7.

TABLE 7

CHINA INK TEST: DISPERSIBILITY WAS SIMPLY EVALUATED BY DROPPING 0.5 g OF CHINA INK INTO WASHING LIQUID AT RESPECTIVE CONCENTRATIONS DETERGENT OF PRESENT INVENTION: INORGANIC SALT DETERGENT—STANDARD CONCENTRATION 1 g/L

| | CONCENTRATION OF WASHING LIQUID OF PRESENT INVENTION (g/L) | | | | | | | | |
|---|---|---|---|---|---|---|---|---|---|
| | 0 | 0.03 | 0.06 | 0.12 | 0.24 | 0.48 | 0.72 | 1 | 2 |
| CONCENTRATION OF DISPERSANT COMPONENT | 0 | 0.0004 | 0.0008 | 0.0016 | 0.0032 | 0.0064 | 0.0096 | 0.0133 | 0.0267 |
| SURFACE TENSION (dyn/cm) | 72.5 | 69 | 67 | 64 | 61 | 59 | 52 | 50.5 | 50 |
| CHINA INK TEST RESULTS | X | X | X | X | X | Δ | ◎ | ◎ | ◎ |

X: SPREADS OVER SURFACE AND CONTAMINATED INNER WALL OF WASHING TANK

Δ: STARTS TO DISPERSE BUT STILL CONTAMINATES

◎: DROPS VERTICALLY WITH RESPECT TO SURFACE OF WASHING LIQUID AND DISPERSED

From the results in Table 7, it was also proved that a certain anti-soil redeposition ability may be seen if the surface tension of the washing liquid of the present invention can be reduced to 58 dyn/cm or less.

Note that an anti-soil redeposition component used in the present invention not only includes those belonging to a category of water soluble high molecular materials normally used as an anti-soil redeposition agent but includes surface-active agents to be included in an amount of no more than a critical micelle concentration in the washing liquid of the present invention having the above predetermined surface tension declining ability.

Next, to search for a range of anti-soil redeposition components able to be used in the present invention, a variety of anti-soil redeposition materials (also referred to as a dispersant) are added to the same washing liquid to the concentration of about 0.017 g/L (equivalent to a component concentration of adding and dissolving 0.5 g of anti-soil redeposition component in 30 liters of washing water) in the washing liquid of the present invention, which is an amount of about 1/10 or less the standard concentration of a surface-active agent (a negative ion system) in existing synthetic detergents, and the anti-soil redeposition efficiency was evaluated. Note that the component composition of the detergent composition of the present invention is 28.6 g of an inorganic salt main ingredient plus 0.5 g of each of the anti-soil redeposition materials. In addition, the component composition of the inorganic salt main ingredient is 10 g of sodium carbonate plus 7.8 g of sodium hydrogen carbonate +10.8 g of sodium metasilicate 5-hydrate. Two kinds of fabrics, cotton and polyester, were used as the cloths to be tested, a certain amount of china ink was dripped in as a soil and the whiteness index differences were compared before and after washing in the washing liquid to be tested. Note that the anti-soil redeposition efficiency evaluation test is conducted under conditions corresponding to the anti-soil redeposition test conditions described later on. The results are shown in Table 8 to Table 10.

TABLE 8

EVALUATION TEST RESULTS OF ANTI SOIL REDEPOSITION EFFICIENCY ON EACH OF VARIOUS ANTI SOIL REDEPOSITION SUBSTANCES BELONGING TO GROUP (a)
*WASHING LIQUID IS (INORGANIC SALT AS MAIN INGREDIENT 28.6 g + EACH OF ANTI SOIL REDEPOSITION SUBSTANCES 0.5 g)/30 L
*INORGANIC SALT AS MAIN INGREDIENT = SODIUM CARBONATE 10 g + SODIUM HYDROGEN CARBONATE 7.8 g + SODIUM METASILICATE 10.8 g = TOTAL AMOUNT OF INORGANIC SALT COMPONENTS 28.6 g

| ANTI SOIL REDEPOSITION SUBSTANCE NAME | SOIL REDEPOSITION DEGREE COTTON | SOIL REDEPOSITION DEGREE PES | NOTE |
|---|---|---|---|
| HYDROXY PROPYL CELLULOSE | 0.03 | −0.99 | HPC M-TYPE |
| POLYVINYL ALCOHOL | 0.20 | −0.34 | PVA SAPONIFICATION DEGREE 88 MOL %, VISCOSITY 5 mPa · S |
| METHYL CELLULOSE | −0.72 | −0.52 | MC METHOXYL GROUP 27.5 TO 31.5%, VISCOSITY GRADE 400 |
| HYDROXY PROPYL METHYL CELLULOSE | −0.48 | −0.18 | HPMC METHOXYL GROUP 28 TO 30%, VISCOSITY GRADE 50 |
| HYDROXY ETHYL METHYL CELLULOSE | 0.57 | −0.24 | HEMC METHOXYL GROUP 21 TO 26%, VISCOSITY GRADE 4000 |
| POLYOXY ETHYLENE POLYOXY PROPYLENE BLOCK CO-POLYMER | 0.14 | −0.04 | PLURONIC L-101 NON-IONIC SYSTEM SURFACE-ACTIVE AGENT |
| POLYPROPYLENE GLICOL | −0.23 | 0.53 | PPG1 TRIOL MOLECULAR WEIGHT 4000 |
| POLYPROPYLENE GLICOL | 2.01 | −0.26 | PPG2 DIOL MOLECULAR WEIGHT 3000 |
| INORGANIC SALT AS MAIN INGREDIENT ALONE (NO ANTI SOIL REDEPOSITION SUBSTANCE) | −3.37 | −3.87 | DETERGENT OF PRESENT INVENTION FROM WHICH ANTI SOIL REDEPOSITION COMPONENT IS |

TABLE 9

EVALUATION TEST RESULTS OF ANTI SOIL REDEPOSITION EFFICIENCY ON EACH OF VARIOUS ANTI SOIL REDEPOSITION SUBSTANCES BELONGING TO GROUP (b)
*WASHING LIQUID IS (INORGANIC SALT AS MAIN INGREDIENT 28.6 g + EACH OF ANTI SOIL REDEPOSITION SUBSTANCES 0.5 g)/30 L
*INORGANIC SALT AS MAIN INGREDIENT = SODIUM CARBONATE 10 g + SODIUM HYDROGEN CARBONATE 7.8 g + SODIUM METASILICATE 10.8 g = TOTAL AMOUNT OF INORGANIC SALT COMPONENTS 28.6 g

| ANTI SOIL REDEPOSITION SUBSTANCE | SOIL REDEPOSITION DEGREE | | |
|---|---|---|---|
| NAME | COTTON | PES | NOTE |
| MONO-OLEIC ACID POLY-OXYETHYLENE SORBITAN | −0.36 | −1.66 | NONION OT-221 HLB-15 |
| MONO-LAURIC ACID POLY-OXYETHYLENE SORBITAN | 0.76 | −1.12 | NONION LT-221 HLB-16.7 |
| LAURYL AMIDE PROPYLACETATE BETAINE | −0.70 | −2.50 | AMPHOLYTIC SURFACE-ACTIVE AGENT |
| POLYETHYLENE GLYCOL OLATE | −0.52 | −2.33 | NON-ION SYSTEM |
| POLYGLYCERIN FATTY ACID ESTER | −0.92 | −3.56 | NON-ION SYSTEM |
| ETHYLENE GLYCOL | −0.74 | −3.68 | EG |
| SODIUM POLYACRYLATE | −1.14 | −3.28 | AVERAGE MOLECULAR WEIGHT 2700~7500 |
| POLYETHYLENE GLYCOL | −3.22 | −4.41 | MOLECULAR WEIGHT 6000 |
| POLYETHYLENE GLYCOL | −4.78 | −6.79 | MOLECULAR WEIGHT 400 |
| HYDROXY ETHYL CELLULOSE | −1.62 | −4.23 | HEC |
| CARBOXY METHYL CELLULOSE − 1 | −2.65 | −4.82 | AVERAGE POLYMERIZATION DEGREE 380~450, ETHERIFICATION DEGREE 0.6~0.7 |
| CARBOXY METHYL CELLULOSE − 2 | −2.13 | −3.89 | AVERAGE POLYMERIZATION DEGREE 1600~1800, ETHERIFICATION DEGREE 0.65~0.75 |
| POLYVINYL PYRROLIDONE − 1 | −8.67 | −5.55 | AVERAGE MOLECULAR WEIGHT 33000 |
| POLYVINYL PYRROLIDONE − 2 | −4.39 | −3.77 | AVERAGE MOLECULAR WEIGHT 360000 |
| INORGANIC SALT AS MAIN INGREDIENT ALONE (NO ANTI SOIL REDEPOSITION SUBSTANCE) | −3.37 | −3.87 | DETERGENT OF PRESENT INVENTION FROM WHICH ANTI SOIL REDEPOSITION COMPONENT IS REMOVED |

TABLE 10

EVALUATION TEST RESULTS OF ANTI SOIL REDEPOSITION EFFICIENCY ON EACH OF VARIOUS ANTI SOIL REDEPOSITION SUBSTANCES BELONGING TO GROUP (c)
*WASHING LIQUID IS (INORGANIC SALT AS MAIN INGREDIENT 28.6 g + EACH OF ANTI SOIL REDEPOSITION SUBSTANCES 0.5 g)/30 L
*INORGANIC SALT AS MAIN INGREDIENT = SODIUM CARBONATE 10 g + SODIUM HYDROGEN CARBONATE 7.8 g + SODIUM METASILICATE 10.8 g = TOTAL AMOUNT OF INORGANIC SALT COMPONENTS 28.6 g

| ANTI SOIL REDEPOSITION | SOIL REDEPOSITION DEGREE | | |
|---|---|---|---|
| SUBSTANCE NAME | COTTON | PES | NOTE |
| n-DODECYL SODIUM SULPHATE | −4.98 | −7.83 | |
| SAPONIN | −4.37 | −6.00 | |
| SODIUM ALGINATE | −6.62 | −6.12 | |
| SODIUM GLUCONATE | −8.64 | −7.29 | |
| INORGANIC SALT AS MAIN INGREDIENT ALONE (NO ANTI SOIL REDEPOSITION SUBSTANCE) | −3.37 | −3.87 | DETERGENT OF PRESENT INVENTION FROM WHICH ANTI SOIL REDEPOSITION COMPONENT IS REMOVED |

As a result, the respective anti-soil redeposition materials were classified into (a) those having both surface tension declining ability as above and hydrophobic anti-soil redeposition ability as above, wherein sufficient anti-soil redeposition efficiency was obtained by the material alone and at a low concentration, (b) those only having one of the surface tension declining ability or the hydrophobic anti-soil redeposition ability, and cannot be used as an anti-soil redeposition component of the present invention by itself, but capable of obtaining practically usable anti-soil redeposition by combining among them to compensate each other or combining with the dispersant in the above (a), and (c) those that cannot obtain anti-soil redeposition efficiency unless under the same concentration as those in conventional synthetic detergents or cannot obtain efficiency in the inorganic salt detergent system.

Dispersants usable as the anti-soil redeposition component of the present invention are, as explained above, those in the group (a) and those in the group (b) that can be used in combination with others.

As those belonging to the group (a), methyl cellulose, hydroxy propyl cellulose, hydroxy propyl methyl cellulose, hydroxy ethyl methyl cellulose, partial saponification type polyvinyl alcohol, polypropylene glycol, polyoxy ethylene polyoxy propylene block co-polymer, and other non-ionic water soluble high molecular substances or non-ionic surface-active agents can be given.

Meanwhile, as those belonging to the group (b), sodium polyacrylate, polyethylene glycol, hydroxy ethyl cellulose, carboxy methyl cellulose, polyvinyl pyrrolidone, and other water soluble high molecular substances, polyoxyethylene sorbitan mono olate, polyglycerin fatty acid ester, ethylene glycol, lauryl amide propylacetate betaine and other non-ionic or ampholytic surface-active agents can be given.

It can be said that those belonging to the group (a) have efficiency in causing the surface tension of the washing liquid to decline to 58 dyn/cm or less with a small amount and further have preferable absorption ability and dispersion ability with hydrophobic fabrics and nonpolar soil. Note that those having favorable hydrophobic anti-soil redeposition ability as above also have favorable absorption ability and dispersion ability with hydrophilic fabrics and polar soil in general.

With those belonging to the group (b), there are non-ionic or amphoteric dispersants having surface tension decline ability but low dispersion ability and anionic dispersants having dispersion ability but not surface tension decline ability, and displays relatively high efficiency with hydrophilic fabrics and polar soil but almost no efficiency with hydrophobic fabrics and nonpolar soil. With the assumption of obtaining anti-soil redeposition efficiency in a small amount of both of cotton and synthetic fabrics (polyester), sufficient anti-soil redeposition efficiency tends to be hard to obtain with those belonging to the group (b) alone.

Anti-soil redeposition efficiency of those belonging to the group (a) becomes higher as the concentration increases, but in terms of reduction the burden on the environment, it is preferable to use as little as possible in the concentration range required in practical use. Note that with these anti-soil redeposition substances, the decline of surface tension hits a limit no matter how much higher the concentration is made, and detergency is affected little by the concentration.

The above will be shown in an example of conducting a test on polyvinyl alcohol (see Table 11).

TABLE 11

INORGANIC SALT AS MAIN INGREDIENT: SODIUM CARBONATE 10 g + SODIUM BICARBONATE 7.8 g + SODIUM METASILICATE 10.8 g
ANTI SOIL REDEPOSITION SUBSTANCE: PARTIAL SAPONIFICATION TYPE POLYVINYL ALCOHOL, SAPONIFICATION DEGREE 88 MOL %, VISCOSITY 5 mPa · S

| PVA ADDITIVE AMOUNT | PVA COMPONENT CONCENTRATION | SOIL REDEPOSITION DEGREE | | DETER- |
|---|---|---|---|---|
| (g) | g/L | COTTON | PES | GENCY % |
| 0.1 | 0.0033 | 0.13 | −2.55 | 38.78 |
| 0.2 | 0.0067 | 0.78 | −1.8 | 34.11 |
| 0.5 | 0.0167 | 0.84 | −0.36 | 38.51 |
| 1.0 | 0.0333 | 1.09 | −0.16 | 39.21 |
| 5.0 | 0.1667 | 1.31 | 0.67 | 37.54 |

EVALUATION RESULTS
ANTI SOIL REDEPOSITION EFFICIENCY: CORRELATION WITH INCREASE OF DISPERSANT CONCENTRATION IS FOUND
DETERGENCY: CORRELATION WITH INCREASE OF DISPERSANT CONCENTRATION IS NOT FOUND

Furthermore, an effect of anti-soil redeposition efficiency of partial saponification type polyvinyl alcohol when changing a parameter of a degree of polymerization is shown (see Table 12).

TABLE 12

*EFFECT OF WHEN CHANGING POLYMERIZATION DEGREE PARAMETER IS EXAMINED ON ANTI SOIL REDEPOSITION EFFICIENCY OF PARTIAL SAPONIFICATION TYPE PVA (POLYVINYL ALCOHOL)

| SPECIFICATION | SOIL REDEPOSITION DEGREE | |
|---|---|---|
| | COTTON | PES |
| POLYMERIZATION DEGREE 3500, PARTIAL SAPONIFICATION TYPE | 0.02 | −2.23 |
| POLYMERIZATION DEGREE 1000, PARTIAL SAPONIFICATION TYPE | 0.97 | −0.55 |

TABLE 12-continued

*EFFECT OF WHEN CHANGING POLYMERIZATION DEGREE PARAMETER IS EXAMINED ON ANTI SOIL REDEPOSITION EFFICIENCY OF PARTIAL SAPONIFICATION TYPE PVA (POLYVINYL ALCOHOL)

| SPECIFICATION | SOIL REDEPOSITION DEGREE | |
|---|---|---|
| | COTTON | PES |
| POLYMERIZATION DEGREE 500, PARTIAL SAPONIFICATION TYPE | 0.81 | −0.81 |

EVALUATION RESULT:
RELATIVELY PREFERABLE ANTI SOIL REDEPOSITION EFFICIENCY IS EXHIBITED IN PARTIAL SAPONIFICATION TYPE PVA HAVING POLYMERIZATION DEGREE OF UP TO 1000

According to Table 12, preferable results are obtained in those having a degree of polymerization up to approximately 1000 among partial saponification type polyvinyl alcohol (PVA).

Furthermore, in order to observe effects of the hydrophobic group, a test was conducted on a pluronic allowing the respective molecular weight component ratio of hydrophilic group polyoxyethylene and hydrophobic polyoxypropylene to be variably changed, obtaining the results in FIG. 2.

From the anti-soil redeposition evaluation results in FIG. 2, preferable results are shown in those having an amount (molecular weight) of hydrophobic base exceeding 3000. A total molecular weight becomes large in the upper right direction of the grid, but since there is little efficiency in those having a small hydrophobic group even if the total molecular weights are the same, the size of the hydrophobic group is considered to be important. Whereas when the sizes of the hydrophobic group are the same, a smaller ratio of a hydrophilic group with respect to the total molecular weight gives a further improved anti-soil redeposition ability for hydrophobic fabrics. In other words, when sizes of hydrophobic groups are the same, it can be said that those having the smaller total molecular weight are advantageous with hydrophobic fabrics.

From the above knowledge, a substance able to be used preferably as an anti-soil redeposition component in the present invention is water soluble high molecular substances, and substances able to be even more preferably used among them are those satisfying the two conditions of being non-ionic and being hydrophobic while having a large hydrophobic group portion in general. Substances able to be yet further preferably used among them are those having a relatively low molecular weight, namely an average molecular weight of about 1000 to 500,000, more preferably, in the range of several thousand. Also, in terms of safeness and biodegradability, a cellulose system, polyvalence alcohol system, or fatty acid system is preferable, specifically, methyl cellulose, hydroxy propyl cellulose, hydroxy propyl methyl cellulose, hydroxy ethyl methyl cellulose, partial saponification type polyvinyl alcohol, and the like are particularly preferable.

Also, clothing are divided to hydrophilic fabrics and hydrophobic fabrics and there is correlation between the anti-soil redeposition component and these fabrics, thus, to obtain sufficient anti-soil redeposition efficiency, a combination of substances in the above group (a) or combination of a substance in the group (a) and a substance in the group (b) are more effective in many cases than when using a substance in the group (a) alone, and a suitable combination of two or more in the substances in the former group (a) is the most preferable.

The results of evaluating combinations of a variety of anti-soil redeposition components are shown in Table 13.

TABLE 13

EVALUATION ON COMBINATION OF ANTI SOIL REDEPOSITION SUBSTANCES
*WASHING LIQUID IS (INORGANIC SALT AS MAIN INGREDIENT 28.6 g + EACH OF ANTI SOIL REDEPOSITION SUBSTANCES 0.5 g)/30 L
*BLENDING RATIO OF TWO KINDS OF SUBSTANCES WERE ALL 1:1 (0.25 g + 0.25 g)
*INORGANIC SALT AS MAIN INGREDIENT = SODIUM CARBONATE 10 g + SODIUM HYDROGEN CARBONATE 7.8 g + SODIUM METASILICATE 10.8 g = TOTAL AMOUNT OF INORGANIC SALT COMPONENTS 28.6 g

| ANTI SOIL REDEPOSITION | SOIL REDEPOSITION DEGREE | | |
|---|---|---|---|
| SUBSTANCE NAME | COTTON | PES | NOTE |
| PVA + HPMC | 0.66 | 0.45 | |
| PVA + CMC | 1.02 | −0.32 | |
| HPMC + CMC | 0.49 | −0.03 | |
| PVA + PEG | 1.31 | −0.68 | |
| HPMC + PEG | −0.34 | −0.54 | |
| HPMC + HEMC | 0.70 | −0.10 | |
| PLURONIC + HPMC | 0.15 | −0.10 | PLURONIC IS L-101 |
| PLURONIC + PVP | 1.26 | −0.52 | PLURONIC IS L-101 |
| LT-221 + HPMC | −0.27 | −0.53 | LT-221; POLY-OXYETHYLENE SORBITAN FATTY ACID ESTER |
| PVP + HPMC | −2.89 | −0.66 | |
| CMC + HPMC | −1.29 | −1.14 | |
| SODIUM POLYACRYLATE + HPMC | −3.01 | −0.71 | |
| SODIUM GLUCONATE + HPMC | −2.88 | −1.03 | |
| SODIUM ALGINATE + HPMC | −2.59 | −0.87 | |
| SDS + HPMC | −2.11 | −0.70 | SDS; DODECYL SODIUM SULPHATE |
| INORGANIC SALT AS MAIN INGREDIENT | −3.37 | −3.87 | DETERGENT OF PRESENT INVENTION FROM WHICH ANTI SOIL REDEPOSITION COMPONENT IS REMOVED |

From Table 13, when combining one displaying a relatively good result on cotton and one displaying a good result on polyester fabric well among the anti-soil redeposition substances of the group (a), it is understood that the anti-soil redeposition efficiency can be exhibited in a balanced way to hydrophilic fabrics and hydrophobic fabrics by a smaller amount, respectively. A particularly preferable result was obtained in a combination of partial saponification type polyvinyl alcohol and hydroxy propylmethyl cellulose in 1:1.

In the detergent composition of the present invention, the total amount of anti-soil redeposition components is preferably no more than 10 wt % of the total amount of the detergent composition.

Under conditions that anti-soil redeposition efficiency reaches a practically usable standard, the total amount of anti-soil redeposition component is more preferably no more than 9 wt % of the total amount of the detergent composition. A smaller blending amount of anti-soil redeposition components in the detergent composition similarly means the more preferable in order of no more than 8 wt %, no more than 7 wt %, no more than 6 wt %, no more than 5 wt %, no more than 4 wt %, no more than 3 wt %, no more than 2 wt % and no more than 1 wt %.

This is because even though the anti-soil redeposition components, such as water soluble high molecular have an important role, they are organic substances in the present invention, and a smaller amount of such organic substances is more in line with an object of the present invention to reduce the burden on the environment.

Also, the concentration of anti-soil redeposition components in the washing liquid obtained by dissolving an inorganic detergent composition of the present invention in water to be 1 g/L on the premise that standard use is no less than 0.007 g/L (0.0007 wt %, equivalent to a component concentration of dissolving 0.02 g of anti-soil redeposition components in 30 liters of washing water), preferably no less than 0.01 g/L (0.001 wt %, equivalent to a component concentration of dissolving 0.3 g of anti-soil redeposition components in 30 liters of washing water). Also, when the inorganic salt blending ratio in the detergent composition of the present invention is made to be 90 wt %, an upper limit of the blending ratio of the anti-soil redeposition components in the composition becomes 10 wt % so an upper limit of the concentration of the anti-soil redeposition components in the washing liquid becomes 0.1 g/L (0.01 wt %, equivalent to a component concentration of dissolving 3 g of anti-soil redeposition components in 30 liters of washing water).

Furthermore, as described above, silicic acid alkali metal salt as one of the inorganic salt component main ingredients for detergency in the present invention does not display as much efficiency as the anti-soil redeposition substances belonging to the group (a), but it may contribute to improvement of anti-soil redeposition efficiency, allowing the usage amount of organic anti-soil redeposition substances belonging to the group (a) to be reduced when used together.

Improvement of anti-soil redeposition efficiency when adding silicate or organic anti-soil redeposition substances to an inorganic salt main ingredient of a combination of sodium bicarbonate and sodium carbonate was confirmed. By replacing by sodium metasilicate at the same weight ratio as sodium carbonate in the main ingredient, the blending ratio was gradually increased and anti-soil redeposition efficiencies were evaluated. Note that the amount of organic

TABLE 14

*MAIN INGREDIENT + DISPERSANT 0.5 g WERE DISSOLVED IN 30 LITTERS OF WATER TO PREPARE SOLUTION AND SOIL REDEPOSITION DEGREE WAS MEASURED FOR EACH WASHING LIQUID.

| DETERGENT | TOTAL AMOUNT OF | | SOIL REDEPOSITION DEGREE | | |
|---|---|---|---|---|---|
| COMPOSITION | DETERGENT g | pH | COTTON | PES | NOTE |
| MAIN INGREDIENT A ALONE | 26 | 10.4 | −1.43 | −8.89 | MAIN INGREDIENT A = T18 g + J8 g = 26 g |

TABLE 14-continued

| | | | | | |
|---|---|---|---|---|---|
| MAIN INGREDIENT B ALONE | 41 | 10.6 | −0.52 | −5.52 | MAIN INGREDIENT B = T9 g + J10 g + MF22 g = 41 g |
| MAIN INGREDIENT A + DISPERSANT | 26.4 | 10.3 | 1.96 | −1.40 | DISPERSANT = MC0.2 g + PVA0.2 g |
| MAIN INGREDIENT B + DISPERSANT | 41.4 | 10.6 | 2.17 | −0.63 | DISPERSANT = MC0.2 g + PVA0.2 g |
| MAIN INGREDIENT C + DISPERSANT | 56.4 | 10.6 | 2.63 | −0.13 | MAIN INGREDIENT C = J16 g + MF40 g = 56 g |

MAIN INGREDIENT { T = SODIUM CARBONATE; J = SODIUM BICARBONATE; MF = SODIUM METASILICATE 9-HYDRATE }

DISPERSANT { MC = METHYL CELLULOSE VISCOSITY GRADE 400; PVA = PARTIAL SAPONIFICATION TYPE POLYVINYL ALCOHOL }

From the results, sodium metasilicate (as 5-hydrate) is preferably 30 to 70 wt % of the total amount of the detergent.

By using water soluble silicate and anti-soil redeposition substances belonging to the group (a) together in this way, the lower limit of the concentration of organic anti-soil redeposition components contained in the washing liquid is lowered to about 0.007 g/L (0.0007 wt %) and a practically usable anti-soil redeposition efficiency can be obtained at a very low concentration. This amount is equivalent to 1/10 or less the organic use amount comparing with that in synthetic detergents of the related arts.

(3) Additives

A detergent of the present invention may further contain substances included ordinary used components in synthetic detergents, etc., such as washing enzymes, oxy-based bleaching agents, disinfectants, perfumes, softening agents and foaming agents, in accordance with needs within a range of not departing from the scope of the present invention.

Of the above additives, the washing enzymes are the most important. They are effective in removing soil that is difficult to removed completely with the detergent system of the present invention containing alkalic inorganic salts as main ingredients and anti-soil redeposition components. As the washing enzymes, there are proteolytic enzyme (protease), lipoclastic enzyme (lipase), cellulolytic enzyme (cellulase), amylolytic enzyme (amylase), etc. Among these, protease is particularly effective on daily soil and cellulase is effective for maintaining whiteness of cotton fabrics and removing solid particle soil when repeatedly washed, and are thus are highly useful.

It is sufficient for the blended amount of enzymes to 0.3% to 3 wt % per one enzyme with respect to the total amount of detergency composition.

Also, since fluidity of the present detergent is alkalescent, ones having an active value not decreasing in their pH ranges must be selected when considering blending of enzymes. Inversely, the pH range is not set in light of only the detergency of alkalic salt but preferably set considering whether the activity of the enzyme to be blended in the composition is sufficiently exhibited.

Note that a point to be particularly careful in blending of enzymes in detergents is stability of enzyme activity in washing water and deactivation due to effective free chlorine included in the washing water has to be particularly noted. Also, the detergent of the present invention contains carbonate as one of main components, but it should be carefully treated since carbonate has an effect of accelerating oxidation reaction caused by the effective free chlorine.

Accordingly, enzymes and reducing agents have to be added at the same time when blending into a detergent. Sulfite and thiosulfate are suitable as a reducing agent, but there is a method of using ammonium sulfate salt and other ammonium salts as a substance to prevent deactivation of enzymes by trapping active chlorine. The blending amount thereof is preferably 0.3% to 3 wt % with respect to the total amount of detergent composition.

As an enzyme system bleaching agent, for example, sodium percarbonate, sodium perborate, or hydrogen peroxide may be given. The detergent composition of the present invention exhibits equivalent detergency as conventional synthetic detergents wherein a surface-active agent is a main ingredient even if an enzyme system bleaching agent is not used, however further improvement of detergency may be expected by adding a bleaching agent.

Disinfectants are blended for the purpose of obtaining an effect of preventing decay and mold of a detergent composition containing organic substances other than disinfectant of clothing to be washed and may be suitably selected from, for example, benzalkonium chloride, paraben, or propylene glycol, according to intended usage. When considering safeness to the human body, it is preferable to add an extract extracted from seeds of citrus fruits. Here, the citrus fruits are grapefruits having a scientific name of Citrus Paradisi and the extract itself have high viscosity, so that it is preferably diluted with water when added and a dispersing agent, such as natural glycerin and propylene glycol, is preferably used. Since an extract of seeds of Citrus Paradisi has an anti-bacterial effect of disinfecting and sanitizing bacteria and microorganisms, an anti-bacterial effect when washing may be expected when added as an anti-bacterial additive to the detergent composition of the present invention. As other disinfectant, a natural disinfectant obtained from, for example, a blend of tea leaves and bamboo.

(4) Production Method of Detergent Composition

As almost all of the raw materials of the detergent composition of the present invention are powder or granular substances, and it is sufficient to uniformly mixing them, it is possible to easily produce in a variety of forms with a variety of methods. The simplest and easiest method is only to agitate and mix the power materials with a well-known batch type mixer, and produce a detergent composition of the present invention in powder or granular form.

To allow convenient single use doses, a tablet or sheet form may be used. Also, it is also possible to manufacture the detergent composition of the present invention in a condensed liquid type detergent by mixing the powder material with water.

Note that when generating alkalescent inorganic salt washing liquid of the present invention through performing circulation type or batch type electrolysis on a sodium hydrogen carbonate solution filled in a washing tank, it is sufficient to separately add in later, for example, anti-soil redeposition components containing the above silicate and water soluble high molecular substances in a powder or solution form.

(5) Washing Liquid

The present invention fundamentally relates to a clothes washing method which washes with a washing liquid comprising inorganic salt for forming an alkalescent buffer system as a main detergency component and an anti-soil redeposition component, and containing substantially no surface-active agents. Also, when washing enzymes are further contained in the washing liquid, the detergency can be all the more improved.

As described above, alkaline inorganic salt of the present invention preferably contains bicarbonate alkali metal salt and carbonate alkali metal salt and/or silicate alkali metal salt as main components, and is preferably dissolved in the washing liquid of the present invention to be a concentration of 1 to 2 g/L (0.1 to 0.2 wt %) as a total amount of alkaline inorganic salt under washing conditions in Japan. The bicarbonate alkali metal salt and carbonate alkali metal salt preferably exist in the ratio of 1:7 to 1:0.2 in content mol numbers, and bicarbonate alkali metal salt and silicate alkali metal salt preferably exist in the ratio of 1:1.2 to 1:0.1 in content mol numbers. Also, when they exist in three components system, in terms of detergency, silicate alkali metal salt can be freely replaced by carbonate alkali metal salt. Note that 5-hydrate of sodium metasilicate is preferable as silicate, in terms of pH, solubility, reduction of total usage amount, and production cost.

The pH of the washing liquid of the present invention (1 g/L concentration) determined mainly by an alkaline inorganic salt buffer system is preferably 9.5 to 11 in terms of detergency, and, for example, the softening rate is more preferably, 10 to 10.6.

In addition, the total amount of (organic) anti-soil redeposition components as another important component in the inorganic washing liquid of the present invention is preferably no less than 0.01 g/L (0.001 wt %). When using sodium metasilicate (5-hydrate) also having an anti-soil redeposition efficiency for 30 to 70 wt % of a total amount of the detergent composition, an organic system anti-soil redeposition component concentration contained in the washing liquid may be made to be 0.007 g/L (0.0007 wt %) or more.

Under general washing conditions of low hardness water and low temperature washing as in Japan, the actual usage concentration of the washing liquid according to the present invention is into the range of 0.5 to 5 g/L (0.05 to 0.5 wt %). Note that the actual use concentration in the above range corresponds to an actual use concentration described in the claims, a use concentration of diluted to about 0.5 g/L (0.05 wt %, equivalent to a concentration of dissolving 15 g of the in 30 liters of washing water) is used for washing lightly soiled clothing, a use concentration heightened to about 5 g/L (0.5 wt %, equivalent to a concentration of dissolving 150 g of the in 30 liters of washing water) is used for soaking and washing in an area where washing water has high hardness, and a suitable concentration is used in accordance with, for example, the amount of clothing to be washed and the amount of washing water in the above range of intermediate concentrations from low concentration to high concentration. The detergent of the present invention exhibits detergency equivalent to or greater than that of existing washing soaps and synthetic detergent in the above actual usage concentration range.

Below, the relationship between the usage amount and pH of the washing liquid in a powder detergent composition having a standard composition of the present invention is shown.

Using detergent composition having a blending ratio of 112 g of sodium carbonate, 60 g of sodium bicarbonate, 110 g of sodium metasilicate 5-hydrate and 18 g of other additives to make up 300 g in the total weight of a detergent and dissolving the same in 30 liters of water, pH values (25 C) of washing liquids at respective concentrations in the range of 0.5 to 5 g/L (0.05 to 0.5 wt %) are as below. Namely, the pH is 10.39 at 0.05 wt % (the usage amount of the powder detergent composition is 15 g/L), 10.64 at 0.10 wt % (usage amount is 30 g), 10.73 at 0.15 wt % (usage amount of 45 g/L), 10.78 at 0.20 wt % (usage amount is 60 g/L), 10.79 at 0.25 wt % (usage amount is 75 g/L), 10.80 at 0.30 wt % (usage amount is 90 g/L), and 10.89 at 0.50 wt % (usage amount is 150 g/L).

EFFECT AND OPERATION OF PRESENT INVENTION

According to the present invention, it is possible to provide a detergent composition having an inorganic salt main ingredient, without using any surface active agents that are questionable in terms of safeness on the human body and a reduction in burden on the environment, or with a largely reduced use amount of surface active agents, having detergency equivalent to or greater than that of detergents containing enzymes and bleaching agents, good handlability, and in particular, excellent anti-soil redeposition efficiency. Also, according to a washing method of clothing, detergent composition for clothing and anti-soil redeposition agents of the present invention, it is possible to satisfy two seemingly contradictory demands of consumers in modern Japan for extremely high standards, that is an inclination towards cleanliness that detests uncleanliness and health-consciousness that detests residual detergent components on clothing.

When dissolving bicarbonate and carbonate and/or silicate of alkali metal in water and setting a specified range for pH and concentration, detergency due to saponification and dispersion of oil-based soil may be obtained through an alkali agent. In addition, since it is a buffer system wherein bicarbonate coexists, a large amount of active alkali salts of carbonate and/or silicate may be used to strength ion strength of detergent liquid, so that an electric repulsion force acts to absorbing anions on both the solid soil and clothing to be washed allowing the solid soil to be easily removed from the surface of clothing to be washed. Moreover, hardness components such as a detergency hindrance factor in a conventional washing system, such as calcium ion and magnesium ion, included in water become carbonate, and calcium carbonate in a colloid state generated through a generation and cohesion process of carbonate that absorbs soil particles in the washing liquid and improves detergency.

Silicate, particularly sodium metasilicate, which generates colloids in solution, originally has an action of absorbing inorganic soil particles to disperse into the washing liquid and also exhibits efficiency in preventing absorption of soil particles to fabrics, that is, soil redeposition. When combining a detergent composition containing carbonate and bicarbonate as main ingredients with silicate, carbonate may be freely replaced by silicate without causing detergency to decline.

By adding an extremely small amount of water soluble high molecular substances having a surface tension decline action and anti-soil redeposition ability on hydrophobic fabrics, such as methyl cellulose, hydroxy propyl cellulose, hydroxy propyl methyl cellulose, hydroxy ethyl methyl cellulose, partial saponification type polyvinyl alcohol, etc. to a detergent composition wherein main detergency is obtained through an inorganic salt, a low anti-soil redeposition efficiency which has been a main factor in preventing alkaline inorganic salt detergents from becoming widely spread may be drastically improved. As a result the detergency can reach the same level of practical usage as synthetic detergents. The water soluble high molecular substances having, for example, the action of causing surface tension to decline is particularly effective on synthetic fabrics like polyester, onto which soil is easily redeposited and is hard to prevent the redeposition. Furthermore, by using the water soluble high molecular substances together with other anti-soil redeposition components including the above sodium metasilicate, the total added amount of the anti-soil redeposition components as a whole can be further reduced.

BEST MODE FOR CARRYING OUT THE INVENTION

Figure 1:
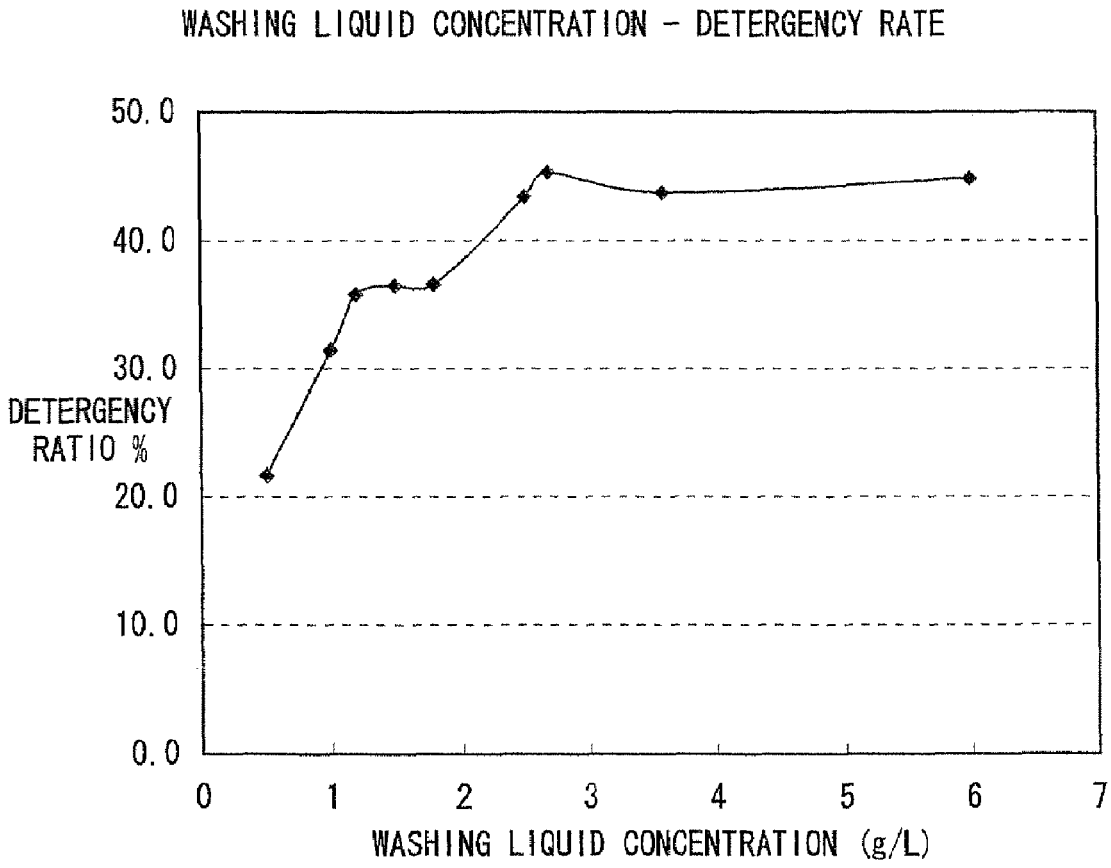
FIG. 1 is a diagram showing change in detergency ratio when changing a concentration parameter of a washing liquid according to the present invention.
Figure 2:
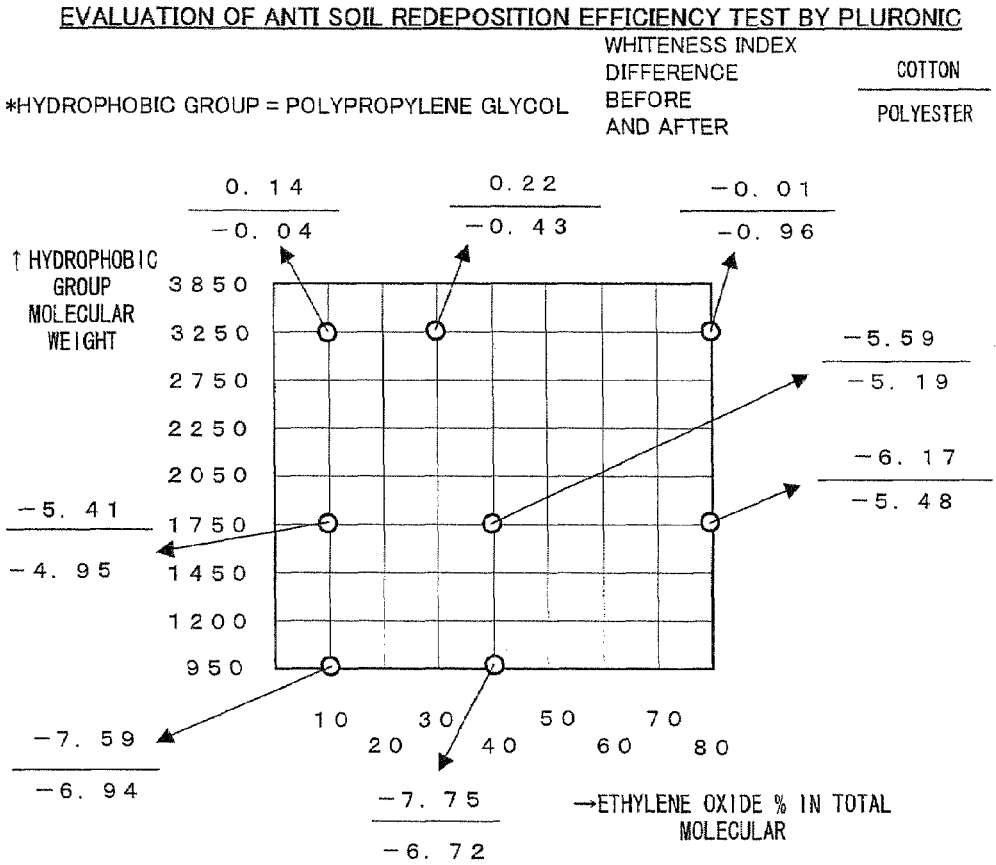
FIG. 2 is a diagram showing of the results of evaluating efficiency of anti-soil redeposition through pluronics.

Below, a specific example of comparing a detergent composition or a washing liquid of the present invention with a detergent composition and washing liquid of the conventional is explained. However, specific values shown below are for disclosing as an example a partial detergency obtained by using the detergency composition of the present invention and not meant to limit the present invention. It should be noted that in examples and comparative examples related to detergency tests disclosed in the present specification, there are cases where detergency changes in accordance with different lot numbers of soiled fabrics to be used, so a simple comparison of values is meaningless between tests using fabrics having respectively different lot numbers.

First Detergency Test

Before describing a first detergency test, testing conditions are established.

Detergency Test Conditions

A washing machine, a fully automatic washing machine (AW-C60VP, 6 kg capacity, water level set to 31 liters, a load of 2 kg of towels) manufactured by Toshiba Corporation, is used to carry out a 12 minute wash cycle with 20° C. tap water (Fujisawa city municipal tap water, pH of 7.5, EC of 19 mS/m), one rinse cycle, and a 5 minute spin cycle.

Three swatches of artificially stained fabric samples (manufactured by Scientific Services S/D Inc., USA, both cotton and blended) stained with artificial sebum, three swatches each of stained fabric samples stained with mineral oil and carbon black (EMPA101), fabric stained with olive oil and carbon black (EMPA106), fabric stained with blood (EMPA112), fabric stained with red wine (EMPA114) and fabric stained with blood, milk and carbon black (EMPA116) were sewn onto towels and laundered. It should be noted that "detergency ratio" is calculated from the following formula:

Detergency ratio (%)=(whiteness index of stained fabric after washing−whiteness index of stained fabric before washing)/(whiteness index of unstained fabric−whiteness index of stained fabric before washing)×100

Here, "whiteness index" is the average of the measure value at ten points on both sides of three respectively different pieces of artificially stained fabric measured by a whiteness tester (manufactured by Minolta Co., Ltd., CR-14, Whiteness Index Color Reader).

It should be noted that the detergency tests disclosed in the present specification are conducted by following these test conditions unless specifically mentioned.

EXAMPLE 1

A washing liquid having a detergent concentration of 1.34 g/L and a pH of 10.6 was obtained by dissolving a total component amount of 41.4 g of detergent having a respective component composition of 9 g of sodium carbonate, 10 g of sodium hydrogen carbonate, 22 g of sodium metasilicate (9-hydrate), 0.2 g of methyl cellulose and 0.2 g of polyvinyl alcohol in 31 liters of tap water. The detergency ratio of the respective stained fabrics was measured before and after washing with the washing liquid. The results are shown in Table 15.

EXAMPLE 2

A washing liquid having a detergent concentration of 1.82 g/L and a pH of 10.6 was obtained by dissolving a total component amount of 56.4 g of detergent having a respective component composition of 16 g of sodium hydrogen carbonate, 40 g of sodium metasilicate (9 hydrate), 0.2 g of methyl cellulose and 0.2 g of polyvinyl alcohol in 31 liters of tap water. The detergency ratio of the respective stained fabrics was measured before and after washing with the washing liquid. The results are shown in Table 15.

EXAMPLE 3

A washing liquid having a detergent concentration of 0.85 g/L and a pH of 10.3 was obtained by dissolving a total component amount of 26.4 g of detergent having a respective component composition of 18 g of sodium carbonate, 8 g of sodium hydrogen carbonate, 0.2 g of methyl cellulose and 0.2 g of polyvinyl alcohol in 31 liters of tap water. The detergency ratio of the respective stained fabrics was measured before and after washing by using the washing liquid. The results are shown in Table 15.

EXAMPLE 4

The detergency ratio of the stained fabric was measured in the same way as in example 1 except for further adding and dissolving 0.3 g of protease and 0.1 g of cellulose as enzymes and 0.6 g of sodium sulfite as a reducing agent, respectively to the washing liquid in example 1. The results are shown in Table 15.

EXAMPLE 5

The detergency ratio of the stained fabric was measured in the same way as in example 1 except for further adding and dissolving 0.3 g of protease and 0.1 g of cellulose as enzymes, 0.6 g of sodium sulfite as a reducing agent and 6 g of sodium percarbonate as a bleaching agent, respectively to the washing liquid in the example 1. The results are shown in Table 15.

COMPARATIVE EXAMPLE 1

As a comparative example of the examples 1 to 5, a washing liquid having a detergent concentration of 0.84 g/L and a pH of 10.4 was obtained by dissolving a total component amount of 26 g of detergent having a respective component composition of 18 g of sodium carbonate, 8 g of sodium hydrogen carbonate in 31 liters of tap water. Detergency ratio of the stained fabric was measured in the same way as in the example 1 by using the washing liquid. The results are shown in Table 15.

COMPARATIVE EXAMPLE 2

As a comparative example of examples 1 to 5, detergency ratio of the stained fabric was measured in the same way as in example 1 using a washing liquid obtained by dissolving a commercially available soap powder (1 g/L, manufactured by Miyoshi Soap Manufacturer Co., Ltd.) in tap water at a standard concentration. The results are shown in Table 15.

COMPARATIVE EXAMPLE 3

As a comparative example of examples 1 to 5, detergency ratio of the stained fabric was measured in the same way as in the example 1 by using a washing liquid obtained by dissolving a commercially available soap powder (Liquid Attack 20 g/31 liter, manufactured by Kao Corporation, with neither enzymes nor bleaching agent) in tap water at a standard concentration. The results are shown in Table 15.

COMPARATIVE EXAMPLE 4

As a comparative example of examples 1 to 5, detergency ratio of the stained fabric was measured in the same way as in example 1 by using a washing liquid obtained by dissolving commercially available synthetic powder detergent (New Beads 0.8 g/L, manufactured by Kao Corporation, enzymes and bleaching agent included) in tap water at a standard concentration. The results are shown in Table 15.

COMPARATIVE EXAMPLE 5

As a comparative example of examples 1 to 5, detergency ratio of the stained fabric was measured in the same way as in the example 1 by using a washing liquid obtained by dissolving commercially available powder synthetic detergent (Attack 0.65 g/L, manufactured by Kao Corporation, enzymes and bleaching agent included) in tap water at a standard concentration. The results are shown in Table 15.

TABLE 15

| | DETERGENT COMPONENT (g) | | | | | | |
|---|---|---|---|---|---|---|---|
| | SODIUM CARBONATE | SODIUM HYDROGEN CARBONATE | SODIUM METASILICATE | METHYL CELLULOSE | POLY-VINYL ALCOHOL | ENZYME | BLEACHING AGENT |
| EXAMPLE 1 | 9 | 10 | 22 | 0.2 | 0.2 | — | — |
| EXAMPLE 2 | 0 | 16 | 40 | 0.2 | 0.2 | — | — |
| EXAMPLE 3 | 18 | 8 | 0 | 0.2 | 0.2 | — | — |
| EXAMPLE 4 | 9 | 10 | 22 | 0.2 | 0.2 | 1 (*1) | — |
| EXAMPLE 5 | 9 | 10 | 22 | 0.2 | 0.2 | 1 (*1) | 6 (*2) |
| COMPARISON EXAMPLE 1 | 18 | 8 | 0 | 0 | 0 | — | — |
| COMPARISON EXAMPLE 2 | MIYOSHI SOAP | | | | | — | — |
| COMPARISON EXAMPLE 3 | LIQUID ATTACK | | | | | — | — |
| COMPARISON EXAMPLE 4 | NEW BEADS | | | | | ○ | ○ |
| COMPARISON EXAMPLE 5 | POWDER ATTACK | | | | | ○ | ○ |

| | DETERGENCY RATIO (%) | | | | | | | |
|---|---|---|---|---|---|---|---|---|
| | USA STAINED FABRIC | | EMPA STAINED FABRIC | | | | | |
| | COTTON | BLENDS | 101 | 106 | 111 | 112 | 114 | 116 |
| EXAMPLE 1 | 20.09 | 37.61 | 12.01 | 14.31 | 86.42 | 16.90 | 33.93 | 11.12 |
| EXAMPLE 2 | 19.72 | 38.89 | 10.93 | 17.15 | 87.50 | 17.06 | 29.93 | 8.85 |
| EXAMPLE 3 | 18.13 | 38.92 | 8.61 | 17.00 | 87.19 | 12.20 | 30.08 | 9.82 |
| EXAMPLE 4 | 20.45 | 37.57 | 11.47 | 16.17 | 93.62 | 30.98 | 33.69 | 40.10 |
| EXAMPLE 5 | 20.96 | 30.42 | 10.00 | 17.23 | 80.28 | 27.30 | 42.75 | 26.58 |
| COMPARISON EXAMPLE 1 | 20.05 | 33.47 | 9.47 | 16.47 | 84.63 | 15.24 | 33.10 | 9.72 |
| COMPARISON EXAMPLE 2 | 28.46 | 24.44 | 7.07 | 13.96 | 71.08 | 14.22 | 43.24 | 15.50 |
| COMPARISON EXAMPLE 3 | 16.72 | 30.34 | 9.20 | 13.98 | 52.80 | 9.40 | 34.62 | 8.11 |
| COMPARISON EXAMPLE 4 | 24.17 | 28.09 | 12.30 | 16.09 | 59.26 | 13.87 | 43.04 | 19.59 |
| COMPARISON EXAMPLE 5 | 21.74 | 29.46 | 12.08 | 17.77 | 66.62 | 15.24 | 40.35 | 21.87 |

(*1) PROTEASE 0.3 g + CELLULASE 0.1 g + SODIUM SULFITE 0.6 g NOTE THAT SODIUM SULFITE IS BLENDED AS REDUCING AGENT (ENZYME DEACTIVATION INHIBITOR)
(*2) SODIUM PERCARBONATE 6 g

As it may be clearly seen by comparing the detergency ratio of working examples 1 to 5 and comparative examples 2 to 5, the washing liquid containing as an anti-soil redeposition agent the inorganic salt of this embodiment as a main ingredient exhibits detergency substantially equal to or greater than that of commercially available laundry soap or synthetic detergent containing a surface-active agent as a main ingredient. Of these, if examples 4 and 5 and comparative examples 2 to 5 are compared, those in the examples 4 and 5 wherein an enzyme and reducing agent or bleaching agent are further added exhibit overall detergency equal to or greater than that of conventional washing soap or synthetic detergency, and it may be understood that they have particularly excellent detergency on protein.

Also, when comparing examples 1 to 3 with comparative example 1, a water soluble high molecular material having a surface tension decline effect, such as methyl cellulose and polyvinyl alcohol, shows little effect in the detergency ratio in the present test wherein washing is conducted once.

Furthermore, when comparing examples 1 and 2 with example 3, it may be understood that detergency is substantially the same even if sodium metasilicate and sodium carbonate are exchanged.

First Soil Redeposition Test

Next, anti-soil redeposition efficiency was confirmed by conducting a first soil redeposition test under the following test conditions:

Soil Redeposition Test Conditions

A washing machine, a double-tub type washing machine manufactured by Sharp Corp (ES-25E, water level set to 30 liters, load of 1.5 kg of towels), was used to carry out a 10 minute wash cycle with 20° C. tap water (Fujisawa city municipal tap water, pH of 7.2, EC of 15.5 mS/m), 4 minute rinse cycle, and a 5 minute spin cycle.

As an artificial soiling agent, 0.45 g of China ink was dripped into this washing machine, and three swatches each of cotton and polyester white fabric (5 $cm^2$) are sewn onto a towel and washed together with stained fabric described below.

Evaluation of soil redeposition is made by measuring whiteness of the above-mentioned three swatches each of cotton and polyester white fabric (5 $cm^2$) before and after washing. The soil redeposition degree used as an evaluation value is the value obtained by subtracting whiteness before washing from the whiteness after washing. When the soil redeposition degree is positive, it means that it became whiter after washing, while when the degree is negative value, it means whiteness declined after washing due to soil redeposition. Accordingly, if the degree of soil redeposition is zero or a positive value, (−1 or greater in the case of polyester), it can be judged that the anti-soil redeposition efficiency has virtually no problem.

It should be noted that the soil redeposition tests disclosed in this specification are conducted by following these test conditions unless specifically mentioned otherwise.

EXAMPLE 6

The washing liquid obtained in example 1 was used for washing and the soil redeposition degree at this time was obtained through calculation. The result is shown in Table 16.

EXAMPLE 7

Soil redeposition was evaluated under the same conditions as in example 6 using the washing liquid obtained in example 2. The results are shown in Table 16.

EXAMPLE 8

Soil redeposition was evaluated under the same conditions as in example 6 using the washing liquid obtained in example 3. The results are shown in Table 16.

COMPARATIVE EXAMPLE 6

As a comparative example of examples 6 to 8, soil redeposition was evaluated under the same conditions as in working example 6 using the washing liquid obtained in comparative example 1. The results are shown in Table 16.

COMPARATIVE EXAMPLE 7

As a comparative example of examples 6 to 8, a washing liquid having a detergent concentration of 1.32 g/L and a pH of 10.6 was obtained by dissolving a total component amount of 41 g of detergent having a respective component composition of 9 g of sodium carbonate, 10 g of sodium hydrogen carbonate and 22 g of sodium metasilicate (9-hydrate) in 31 liters of tap water. Soil redeposition was evaluated under the same conditions as in working example 6 using the washing liquid. The results are shown in Table 16.

COMPARATIVE EXAMPLE 8

As a comparative example of examples 6 to 8, soil redeposition was evaluated under the same conditions as in working example 6 using the washing liquid in comparative example 3. The results are shown in Table 16.

TABLE 16

| | DETERGENT COMPONENT (g) | | | | | | | DEGREE OF SOIL REDEPOSITION | |
|---|---|---|---|---|---|---|---|---|---|
| | SODIUM CARBONATE | SODIUM HYDROGEN CARBONATE | SODIUM META-SILICATE | METHYL CELLULOSE | POLY-VINYL ALCOHOL | ENZYME | BLEACH-ING AGENT | COTTON | POLYESTER |
| EXAMPLE 6 | 9 | 10 | 22 | 0.2 | 0.2 | — | — | 2.17 | −0.63 |
| EXAMPLE 7 | 0 | 16 | 40 | 0.2 | 0.2 | — | — | 2.63 | −0.13 |
| EXAMPLE 8 | 18 | 8 | 0 | 0.2 | 0.2 | — | — | 1.96 | −1.40 |
| COMPARITIVE EXAMPLE 6 | 18 | 8 | 0 | 0 | 0 | — | — | −1.43 | −8.89 |
| COMPARITIVE EXAMPLE 7 | 9 | 10 | 22 | 0 | 0 | — | — | −0.52 | −5.52 |
| COMPARITIVE EXAMPLE 8 | LIQUID ATTACK | | | | | — | — | 3.70 | 0.35 |

As it may be clearly seen from the results, although the soil redeposition degree is too large to put into practical use when a water soluble high molecular material is not added (refer to comparative examples 6 and 7), the washing liquid in the examples 6 to 8 wherein a water soluble high molecular material is added, even the one having the lowest anti-soil redeposition efficiency (example 8) has a higher anti-soil redeposition efficiency than either of those in the comparative examples 6 and 7.

Comparing this with examples 6 to 8, it may be understood that a larger content of sodium metasilicate leads to higher anti-soil redeposition efficiency.

Second Soil Redeposition Test

EXAMPLE 9

A washing liquid having a detergent concentration of 1.34 g/L and a pH of 10.6 was obtained by dissolving a total component amount of 41.4 g of detergent having a respective component composition of 9 g of sodium carbonate, 10 g of sodium hydrogen carbonate, 22 g of sodium metasilicate (9-hydrate) and 0.4 g of methyl cellulose in 31 liters of tap water. Using this washing liquid, soil redeposition was evaluated under the same conditions as the example 6. The results are shown in Table 17.

EXAMPLE 10

A washing liquid having a detergent concentration of 1.34 g/L and a pH of 10.6 was obtained by dissolving a total component amount of 41.4 g of detergent having a respective component composition of 9 g of sodium carbonate, 10 g of sodium hydrogen carbonate, 22 g of sodium metasilicate (9-hydrate) and 0.4 g of polyvinyl alcohol in 31 liters of tap water. Using this washing liquid, soil redeposition was evaluated under the same conditions as in the example 6. The results are shown in Table 17.

EXAMPLE 11

A washing liquid having a detergent concentration of 1.34 g/L and a pH of 10.7 was obtained by dissolving a total component amount of 41.4 g of detergent having a respective component composition of 9 g of sodium carbonate, 10 g of sodium hydrogen carbonate, 22 g of sodium metasilicate (9-hydrate) and 0.4 g of hydroxy propyl cellulose in 31 liters of tap water. Using this washing liquid, soil redeposition was evaluated under the same conditions as in the example 6. The results are shown in Table 17.

EXAMPLE 12

A washing liquid having a detergent concentration of 1.34 g/L and a pH of 10.7 was obtained by dissolving a total component amount of 41.6 g of detergent having a respective component composition of 9 g of sodium carbonate, 10 g of sodium hydrogen carbonate, 22 g of sodium metasilicate (9-hydrate), 0.2 g of hydroxy propyl cellulose and 0.2 g of polyethylene glycol in 31 liters of tap water. Using this washing liquid, soil redeposition was evaluated under the same conditions as in the example 6. The results are shown in Table 17.

EXAMPLE 13

A washing liquid having a detergent concentration of 1.34 g/L and a pH of 10.6 was obtained by dissolving a total component amount of 41.6 g of detergent having a respective component composition of 9 g of sodium carbonate, 10 g of sodium hydrogen carbonate, 22 g of sodium metasilicate (9-hydrate), 0.45 g of LT and 0.15 g of carboxy methyl cellulose in 31 liters of tap water. Using this washing liquid, soil redeposition was evaluated under the same conditions as in the example 6. The results are shown in Table 17.

COMPARATIVE EXAMPLE 9

As a comparative example of the examples 9 to 13, washing liquid having a detergent concentration of 1.32 g/L and a pH of 10.6 was obtained by dissolving a total component amount of 41 g of detergent having a respective component composition of 9 g of sodium carbonate, 10 g of sodium hydrogen carbonate and 22 g of sodium metasilicate (9-hydrate) in 31 liters of tap water. Using this washing liquid, soil redeposition was evaluated under the same conditions as in the example 6. The results are shown in Table 17.

TABLE 17

| | DETERGENT COMPOSITION (g) | | | | | | | | | DEGREE OF SOIL REDEPOSITION | |
|---|---|---|---|---|---|---|---|---|---|---|---|
| | SODIUM CARBONATE | SODIUM HYDROGEN CARBONATE | SODIUM METASILICATE | METHYL CELLULOSE | POLYVINYL ALCOHOL | HYDROXY PROPYL ALCOHOL | POLYETHYLENE GLYCOL | LT | CARBOXY METHYL CELLULOSE | COTTON | POLYESTER |
| EXAMPLE 9 | 9 | 10 | 22 | 0.4 | 0 | 0 | 0 | 0 | 0 | 1.33 | −0.71 |
| EXAMPLE 10 | 9 | 10 | 22 | 0 | 0.4 | 0 | 0 | 0 | 0 | 2.23 | −0.51 |
| EXAMPLE 11 | 9 | 10 | 22 | 0 | 0 | 0.4 | 0 | 0 | 0 | 1.66 | −0.42 |
| EXAMPLE 12 | 9 | 10 | 22 | 0 | 0 | 0.2 | 0.2 | 0 | 0.2 | 1.47 | −1.31 |
| EXAMPLE 13 | 9 | 10 | 22 | 0 | 0 | 0 | 0 | 0.45 | 0.15 | 2.21 | −2.97 |
| COMPARITIVE EXAMPLE 9 | 9 | 10 | 22 | 0 | 0 | 0 | 0 | 0 | 0 | −0.52 | −5.52 |

As it may be clearly seen from the results of this soil redeposition test 2, where the type and amount of anti-soil redeposition agent are compared by forming various combinations while keeping constant the blending ratios and amounts in the component composition of the inorganic salt main ingredient, in the case of simply adding a water soluble high molecular substance, it is understood that polyvinyl alcohol (see example 10) exhibits the most preferable anti-soil redeposition efficiency considering both cotton and synthetic fabrics (polyester).

Second Detergency Test

A second detergency test was conducted under the testing conditions followed in the first detergency test, and detergency was compared and confirmed vis-à-vis that of existing synthetic detergents and washing soaps.

EXAMPLE 14

The detergency ratio of each stained fabric was measured before and after washing, wherein washing was carried out using a washing liquid obtained by dissolving 30 g of detergent A (no enzymes added) of the present invention having the following component composition in 31 liters of washing water (tap water). The results are shown in Table 18.

Composition of Detergent A (no enzymes added) of Present Invention

| | |
|---|---|
| sodium carbonate | 10.5 g |
| sodium bicarbonate | 8.0 g |
| sodium metasilicate | 11 g |
| PVA | 0.25 g |
| HPMC | 0.25 g |
| total amount | 30.0 g |

EXAMPLE 15

The detergency ratio of each stained fabric was measured before and after washing, wherein washing was carried out using a washing liquid obtained by dissolving 30 g of detergent B (enzymes added) of the present invention having the following component composition in 31 liters of washing water (tap water).

The results are shown in Table 18.

Composition of Detergent B (enzymes added) of Present Invention

| | |
|---|---|
| sodium carbonate | 10.0 g |
| sodium bicarbonate | 7.8 g |

-continued

| | |
|---|---|
| sodium metasilicate | 10.8 g |
| PVA | 0.2 g |
| HPMC | 0.2 g |
| protease | 0.2 g |
| cellulase | 0.2 g |
| sodium sulfite | 0.6 g |
| total amount | 30.0 g |

COMPARATIVE EXAMPLE 10

As a comparative example of the examples 14 and 15, detergency on the stained fabrics were measured in the same way as in the example 14 by using a washing liquid (detergent concentration of 20 ml/31 liters, enzymes added) obtained by diluting and dissolving a commercially-available liquid synthetic detergent in tap water in the standard concentration. The results are shown in Table 18.

COMPARATIVE EXAMPLE 11

As a comparative example of the examples 14 and 15, detergency of stained fabrics was measured in the same way as in the example 14 using a washing liquid (0.65 g/L, enzymes and fluorescent whitening agents added) obtained by dissolving a commercially-available powder synthetic detergent in tap water in the standard concentration. The results are shown in Table 18.

COMPARATIVE EXAMPLE 12

As a comparative example of the examples 14 and 15, detergency of stained fabrics were measured in the same way as in the example 14 using a washing liquid (for atop patients, surface active agents are added by 9%) obtained by dissolving a commercially-available liquid detergent in tap water in the standard concentration. The results are shown in Table 18.

COMPARATIVE EXAMPLE 13

As a comparative example of the examples 14 and 15, detergency of stained fabrics were measured in the same way as in the example 14 using a washing liquid (a washing liquid concentration is 1 g/L) obtained by dissolving a commercially-available pure soap powder in tap water in the standard concentration. The results are shown in Table 18.

The results of conducting a detergency test on the above examples 14 and 15 and comparative examples 10 to 13 are shown in Table 18.

TABLE 18

| | KINDS OF DETERGENT | STANDARD STAINED FABRIC DETERGENCY RATIO % | USA STAINED FABRIC, DETERGENCY RATIO % | | | EMPA STAINED FABRIC, DETERGENCY RATIO % | | | | | |
|---|---|---|---|---|---|---|---|---|---|---|---|
| | | | COTTON | BLENDS | PES | 101 | 106 | 111 | 112 | 114 | 116 |
| EXAMPLE 14 | DETERGENT A OF PRESENT INVENTION | 33.4 | 29.8 | 34.3 | 54.7 | 11.5 | 17.4 | 84.1 | 19.6 | 13.0 | 8.6 |
| EXAMPLE 15 | DETERGENT B OF PRESENT INVENTION | 33.6 | 27.2 | 31.7 | 58.5 | 12.8 | 13.7 | 91.2 | 36.3 | 15.7 | 36.5 |

TABLE 18-continued

| | KINDS OF DETERGENT | STANDARD STAINED FABRIC DETERGENCY RATIO % | USA STAINED FABRIC, DETERGENCY RATIO % | | | EMPA STAINED FABRIC, DETERGENCY RATIO % | | | | | |
|---|---|---|---|---|---|---|---|---|---|---|---|
| | | | COTTON | BLENDS | PES | 101 | 106 | 111 | 112 | 114 | 116 |
| COMPARITIVE EXAMPLE 10 | LIQUID SYNTHETIC DETERGENT | 36.6 | 25.7 | 31.7 | 27.6 | 12.5 | 15.7 | 42.8 | 15.6 | 23.6 | 13.9 |
| COMPARITIVE EXAMPLE 11 | POWDER SYNTHETIC DETERGENT | 35.1 | 28.4 | 28.3 | 46.7 | 13.5 | 12.5 | 76.0 | 22.8 | 23.8 | 23.8 |
| COMPARITIVE EXAMPLE 12 | POWDER DETERGENT | 26.3 | 18.6 | 23.9 | 25.6 | 10.3 | 11.9 | 38.5 | 10.5 | 22.6 | 6.2 |
| COMPARITIVE EXAMPLE 13 | POWDER PURE SOAP | 27.2 | 36.8 | 26.6 | 35.3 | 8.6 | 17.5 | 62.8 | 24.4 | 27.2 | 16.2 |

As it may be clearly seen from comparing the detergency ratio of the examples 14 and 15 with that of the comparative examples 10 to 13, all of the washing liquids of this example including an anti-soil redeposition component having an inorganic salt main ingredient exhibit detergency that is substantially equal to or greater than that of commercially-available washing soaps or synthetic detergents with a surface active agent as the main washing ingredient. Among these, when comparing the examples 14 and 15 with the comparative examples 10 to 13, it may be understood that the one in the example 15 to which enzymes and reducing agents are further added exhibits detergency that is equivalent to or greater than washing soaps and synthetic detergents in general and has particularly excellent detergency on protein soil.

Third Soil Redeposition Test

A third soil redeposition test was conducted under the test conditions followed in the first soil redeposition test and anti redeposition efficiency was compared and confirmed vis-à-vis that of existing synthetic detergents and washing soaps.

EXAMPLE 16

Washing was carried out using a washing liquid obtained by dissolving 30 g of detergent A (no enzymes added) of the present invention having the same component composition as example 14 in 31 liters of washing water (tap water) and the degree of soil redeposition at this time was obtained through calculation. The results are shown in Table 19.

EXAMPLE 17

Washing was carried out using a washing liquid obtained by dissolving 30 g of detergent B (enzymes added) of the present invention having the same component composition as example 14 in 31 liters of washing water (tap water) and the degree of soil redeposition at this time was obtained through calculation. The results are shown in Table 19.

COMPARATIVE EXAMPLE 14

As a comparative example of the examples 16 and 17, washing was carried out using the same washing liquid as in the comparative example 10 and a soil redeposition degree at this time was obtained by calculation. The results are shown in Table 19.

COMPARATIVE EXAMPLE 15

As a comparative example of the examples 16 and 17, washing was carried out using the same washing liquid as in the comparative example 11 and the degree of soil redeposition at this time was obtained through calculation. The results are shown in Table 19.

COMPARATIVE EXAMPLE 16

As a comparative example of the examples 14 and 15, washing was carried out using the same washing liquid as in the comparative example 12 and the degree of soil redeposition at this time was obtained through calculation. The results are shown in Table 19.

COMPARATIVE EXAMPLE 17

As a comparative example of the examples 14 and 15, washing was carried out using the same washing liquid as in the comparative example 13 and the degree of soil redeposition at this time was obtained through calculation. The results are shown in Table 19.

TABLE 19

| | KINDS OF DETERGENT | DEGREE OF SOIL REDEPOSITION COTTON | PES | NOTE |
|---|---|---|---|---|
| EXAMPLE 16 | DETERGENT A OF PRESENT INVENTION | 2.86 | −0.07 | ENZYME NOT CONTAINED |
| EXAMPLE 17 | DETERGENT B OF PRESENT INVENTION | 2.86 | −0.12 | ENZYME CONTAINED |
| COMPARITIVE EXAMPLE 14 | LIQUID SYNTHETIC DETERGENT | 2.45 | 0.14 | ENZYME CONTAINED |
| COMPARITIVE EXAMPLE 15 | POWDER SYNTHETIC DETERGENT | 2.94 | 0.27 | ENZYME AND FLUO-RESCENT WHITENING AGENT CONTAINED |
| COMPARITIVE EXAMPLE 16 | LIQUID DETERGENT | 2.74 | 0.04 | FOR ATOPY PATIENTS, SURFACE-ACTIVE AGENT CONTAINED 9% |
| COMPARITIVE EXAMPLE 17 | POWDER PURE SOAP | 2.30 | −0.94 | POWDER—PURE SOAP |

It is understood that any of the washing liquids of the present invention containing anti-soil redeposition agents according to a combination of PVA (poly vinyl alcohol) and HPMC (hydroxy propyl methyl cellulose) selected based on the knowledge obtained by conducting efficiency evaluation tests on an assumption of using a variety of anti-soil redeposition substances alone or in combination on a premise of being used in combination with an inorganic detergent of the present invention exhibits, as is obvious from the results of the present soil redeposition test 3, an anti soil efficiency equivalent to or greater than that of commercially-available washing soaps or synthetic detergents sold at market having a surface active agent as the main washing ingredients for both on cotton and synthetic fabrics (polyester) without regard to the existence of added enzymes.

COD/BOD Analysis Test

Results of COD and BOD analysis testing on the washing liquid obtained by dissolving a detergent of the present invention in water in the actual usage concentration of 1 g/L (0.1 wt %) and a washing liquid obtained by dissolving a commercially-available powder synthetic detergent in water in the standard concentration are shown in Table 20. Note that this analysis test was conducted by following that laid out in the JIS industrial waste water test method.

TABLE 20

RESULTS OF COD/BOD ANALYSIS TEST - BY JIS K 0102:0998 "INDUSTRIAL WASTE WATER TEST METHOD"

| ANALYSIS TEST ITEM | POWDER SYNTHETIC DETERGENT | MiZ DETERGENT | TAP WATER (REFERENCE) |
|---|---|---|---|
| CHEMICAL OXYGEN DEMAND (COD) | 330 mg/L | 17 mg/L | NOT MORE THAN 1 mg/L |

TABLE 20-continued

RESULTS OF COD/BOD ANALYSIS TEST - BY JIS K 0102:0998 "INDUSTRIAL WASTE WATER TEST METHOD"

| ANALYSIS TEST ITEM | POWDER SYNTHETIC DETERGENT | MiZ DETERGENT | TAP WATER (REFERENCE) |
|---|---|---|---|
| BIOCHEMICAL OXYGEN DEMAND (BOD) | 190 mg/L | 8 mg/L | NOT MORE THAN 5 mg/L |

From the analysis test results in Table 20, a washing liquid obtained with the detergent of the present invention has a COD and BOD, respectively, that are approximately 1/20 those of a washing liquid obtained with a commercially-available powder synthetic detergent. Accordingly, it may be understood that a reduction of burden on the environment may be expected by laundering with the detergent of the present invention instead of existing synthetic detergents.

Fish Toxicity Test

Using killifish as the aquatic species, and using as solution [water] into which the killifish are loaded, a washing liquid (a standard concentration: 0.7 g/L (0.07 wt %)) obtained by dissolving a commercially-available powder synthetic detergent, a washing liquid (standard concentration: 1 g/L (0.1 wt %)) obtained by dissolving a powder pure soap in water and a washing liquid (standard concentration: 1 g/L (0.1 wt %)) obtained by dissolving a detergent of the present invention in water were set to have concentrations of standard, 5× dilution and 25× dilution, respectively and washing liquids are prepared, ten of the killifish were raised at a rate of one fish per one liter in the respective washing liquids, and the survival rate over time was observed. The results of the fish toxicity test are shown in Table 21.

TABLE 21

RESULTS OF FISH TOXICITY TEST

| KINDS OF DETERGENT | TEST LIQUID CONCENTRATION | TIME PASSED—SURVIVAL RATE % OF KILLIFISH 12 HOURS | 24 HOURS | 48 HOURS | 96 HOURS | NOTE |
|---|---|---|---|---|---|---|
| POWDER SYNTHETIC DETERGENT | STANDARD CONCENTRATION | 0 | — | — | — | ALL DEAD IN 1.5 HOURS |
| | 5 × DILUTION | 0 | — | — | — | ALL DEAD IN 1.5 HOURS |
| | 25 × DILUTION | 100 | 100 | 100 | NOT TESTED | |
| POWDER PURE SOAP | STANDARD CONCENTRATION | 0 | — | — | — | ALL DEAD IN 2 HOURS |
| | 5 × DILUTION | 100 | 100 | 70 | NOT TESTED | |
| | 25 × DILUTION | 100 | 100 | 100 | NOT TESTED | |
| DETERGENT OF PRESENT INVENTION | STANDARD CONCENTRATION | 100 | 100 | 100 | 100 | |
| | 5 × DILUTION | 100 | 100 | 100 | 100 | |
| | 25 × DILUTION | 100 | 100 | 100 | 100 | |

*STANDARD CONCENTRATION . . . CALCULATED FROM STANDARD USE AMOUNT IN 30 LITERS OF WATER POWDER SYNTHETIC DETERGEN 0.07% POWDER PURE 0.10% DETERGENT OF PRESENT INVENTION: 0.10%
*TEN KILLIFISH ARE USED AT A RATE OF ONE PER ONE LITTER

From the results of the fish toxicity test in Table 21, it can be said that the washing liquid of the present invention has extremely high safeness on aquatic lives comparing with washing liquids obtained with commercially-available powder synthetic detergent and powder pure soaps.

Specifying Chemicals to be Used

The utilized chemicals disclosed in this specification were as follows:

sodium carbonate: soda ash, Tokuyama Co., Ltd.

sodium bicarbonate: sodium bicarbonate, Tosoh Corporation sodium metasilicate: metasilicic acid soda 5-hydrate 28 to 30% of $Na_2O$ and 27 to 29% of $SiO_2$, Nippon Chemical Co., Ltd.

sodium sulfite: anhydrous sodium sulfite, Daito Chemical Co., Ltd.

methyl cellulose: Metolose SM MC 400, Shin-Etsu Chemical Co., Ltd.

hydroxy propyl cellulose: HPC M-type, Tokuyama Co., Ltd.

hydroxy propyl methyl cellulose: Metolose SH SEB-04T, Shin-Etsu Chemical Co., Ltd.

hydroxy propyl ethyl methyl cellulose: Metolose SE SNB-30T, Shin-Etsu Chemical Co., Ltd.

polyvinyl alcohol: POVAL PA-05S Shin-Etsu Chemical Co., Ltd.

degree of polymerization 3500, partial sapobification type degree of polymerization 1000, partial sapobification type degree of polymerization 500, partial sapobification type Wako Pure Chemical Industries, Ltd., reagent polypropylene glycol:

triol molecular weight of 4000 Wako Pure Chemical Industries, Ltd.

diol molecular weight of 3000 Wako Pure Chemical Industries, Ltd.

Pluronic: ADEKA Pluronic (L31, L34, L61, F68, L101, P103, F108) Asahi Denka Kogyo K.K.

enzyme 1: protease, Properase1000E, Nagase ChemteX Corporation enzyme 2: cellulase, celluzyme 0.7T, Novozymes Japan surface active agents:

nonion, (OT-221, LT-221), NOF Corporation lauryl amide propylacetate betaine, PB-30L, Asahi Denka Kogyo K.K.

polyglycerol fatty acid ester, CPG-150, Asahi Denka Kogyo K.K.

polyethylene glycol olate, OEG-106, Asahi Denka Kogyo K.K.

others:

ethylene glycol, Wako Pure Chemical Industries, Ltd.

polyethylene glycol PEG-6000, molecular weight of 6000, and PEG-400, molecular weight of 400, Wako Pure Chemical Industries, Ltd.

hydroxy ethyl cellulose, SP-400, Daicel Chemical Industries, Ltd.

carboxy methyl cellulose, WS-D etherification degree of 0.6 to 0.7, and BSH-12 etherification degree of 0.65 to 0.75, Dai-ichi Kogyo Seiyaku Co., Ltd.

polyvinyl pyrrolidone (PVP) average molecular weight of 33000 and average molecular weight of 360000, Wako Pure Chemical Industries, Ltd.

sodium polyacrylate average molecular weight of 2700 to 7500

INDUSTRIAL APPLICABILITY

A detergent composition of the present invention, which uses an alkaline inorganic salt as a main washing ingredient and uses substantially no surface active agents, has detergency and handlability equal to or greater than that of conventional washing soaps or synthetic detergents, which use surface active agents as a main ingredient.

The present invention described above clearly has many diversifications being within the scope of equivalency. All modifications that will become obvious to those skilled in the art are included in the technical scope of the claims according to the present invention without such diversifications being considered as departing from the spirit and scope of the present invention.

The invention claimed is:

1. A clothes washing method characterized by washing with a washing liquid obtained by dissolving in water a detergent composition that does not include a surface active agent, but includes, as a substantial active component for detergency, a washing component comprising:

A) an alkaline inorganic salt selected from the group consisting of:

i) carbonate alkali metal salt, ii) silicate alkali metal salt, iii) carbonate alkali metal salt and bicarbonate alkali metal salt, iv) bicarbonate alkali metal salt and silicate alkali metal salt, v) carbonate alkali metal salt and silicate alkali metal salt; and B) an anti-soil redeposition component that prevents resoiling of hydrophilic fibers and hydrophobic fibers when coexisting with said inorganic salt, which is a water-soluble polymer substance of a non-ionic system including at least one species selected from the group consisting of an acetyl group, methoxy group, hydroxypropyl group, and poly-oxy propylene group as the hydrophobic group, and including a hydroxyl group as the hydrophilic group;

wherein the detergent composition has a pH between 9.5 and 11, is dissolved in a concentration of 0.5 to 5 g/L to form the washing liquid, and through the existence of said anti-soil redeposition component, has surface tension of 58 dyne/cm or less.

2. A clothes washing detergent that does not include a surface active agent, but includes, as a substantial active component for detergency, a washing component comprising:

A) an alkali inorganic salt selected from the group consisting of:

i) carbonate alkali metal salt, ii) silicate alkali metal salt, iii) carbonate alkali metal salt and bicarbonate alkali metal salt, iv) bicarbonate alkali metal salt and silicate alkali metal salt, v) carbonate alkali metal salt and silicate alkali metal salt; and B) an anti-soil redeposition component that prevents resoiling of hydrophilic fibers and hydrophobic fibers when coexisting with said inorganic salt, which is a water-soluble polymer substance of a non-ionic system including at least one species selected from the group consisting of an acetyl group, methoxy group, hydroxypropyl group, and poly-oxy propylene group as the hydrophobic group, and including a hydroxyl group as the hydrophilic group;

wherein the detergent composition has a pH between 9.5 and 11, is dissolved in a concentration of 0.5 to 5 g/L to form a washing liquid, and through the existence of said anti-soil redeposition component, the surface tension thereof is 58 dyne/cm or less.

* * * * *